US012448888B2

(12) United States Patent
Mladjan et al.

(10) Patent No.: US 12,448,888 B2
(45) Date of Patent: Oct. 21, 2025

(54) METHOD AND APPARATUS FOR USING ELECTRO-MAGNETIC RADIATION IN NARROW VEIN MINING

(71) Applicant: Sidney Resources Corporation, Coeur d'Alene, ID (US)

(72) Inventors: Gary J. Mladjan, Post Falls, ID (US); Gabriel J. Achenbach, Spokane, WA (US); David M. Irish, Sandpoint, ID (US)

(73) Assignee: Sidney Resources Corporation, Coeur d/ Alene, ID (US)

( * ) Notice: Subject to any disclaimer, the term of this patent is extended or adjusted under 35 U.S.C. 154(b) by 180 days.

(21) Appl. No.: 18/103,991

(22) Filed: Jan. 31, 2023

(65) Prior Publication Data

US 2023/0332502 A1 Oct. 19, 2023

Related U.S. Application Data

(60) Provisional application No. 63/331,611, filed on Apr. 15, 2022.

(51) Int. Cl.
*E21C 37/18* (2006.01)

(52) U.S. Cl.
CPC ..... *E21C 37/18* (2013.01)

(58) Field of Classification Search
CPC ..... E21C 37/18; E21B 7/15; E21B 7/14
See application file for complete search history.

(56) References Cited

U.S. PATENT DOCUMENTS

| | | | | | |
|---|---|---|---|---|---|
| 3,539,221 | A * | 11/1970 | Gladstone | E21C 37/18 | 125/1 |
| 3,718,367 | A * | 2/1973 | Schumacher | H01J 37/301 | 37/348 |
| 3,891,039 | A * | 6/1975 | Lagerstrom | E21B 45/00 | 299/1.4 |
| 5,255,959 | A * | 10/1993 | Loegel | B26F 3/004 | 239/128 |
| 5,771,984 | A * | 6/1998 | Potter | E21B 7/15 | 175/14 |
| 8,342,261 | B2 * | 1/2013 | Ahola | E21B 7/025 | 175/2 |
| 10,415,338 | B2 * | 9/2019 | Batarseh | G02B 19/0009 | |
| 2004/0182842 | A1 * | 9/2004 | Denney | B23K 26/0622 | 219/121.84 |
| 2008/0245568 | A1 * | 10/2008 | Jeffryes | E21B 7/06 | 175/73 |
| 2009/0321132 | A1 * | 12/2009 | Ouellet | E21B 7/15 | 175/11 |
| 2017/0067341 | A1 * | 3/2017 | Baiden | B25J 11/00 | |
| 2017/0152744 | A1 * | 6/2017 | Mladjan | E21C 41/16 | |

* cited by examiner

*Primary Examiner* — Carib A Oquendo
(74) *Attorney, Agent, or Firm* — Randall Danskin P.S.

(57) ABSTRACT

A method and apparatus for using Electro-Magnetic Radiation (EMR) to thermally fracture/melt and/or vaporize geologic material in narrow vein mining operations including explosive installation preparation, safety rock bolting operations, drifting, expanding raises and winzes, and stope mining. A thermal fracturing Scanhead directs a beam of predetermined diameter and power across a work surface causing stress fracturing and also to cause the rock to melt and/or vaporize to a predetermined depth. Spalled chips removed from the work surface are collected and transported for further processing.

15 Claims, 12 Drawing Sheets

METHOD AND APPARATUS FOR USING ELECTRO-MAGNETIC RADIATION IN NARROW VEIN MINING

RELATED APPLICATIONS

This US Non-provisional Patent Application claims priority to earlier filed U.S. Provisional Patent Application No. 63/331,611 filed on Apr. 15, 2022, titled "Method and Apparatus for using Electromagnetic Radiation in Narrow Vein Mining". The entire contents of the aforementioned U.S. Provisional Patent Application No. 63/331,611 is fully and completely incorporated herein by this reference. The inventorship of earlier filed U.S. provisional patent application No. 63/331,611 and the present non-provisional application is at least partially overlapping. Pursuant to USPTO rules, this priority claim is also included in the Application Data Sheet filed contemporaneously herewith.

FIELD OF THE INVENTION

This invention is an improvement to known methods and apparatus relating to narrow vein mining for precious metals and gemstones. More specifically the invention relates to improvements using multi-kilowatt Electro Magnetic Radiation generators in thermal stress fracturing and/or spallation of strata; to facilitate and differentiate between desired minerals and waste material; the retrieval of desired materials; and movement and disposal of waste materials.

This invention further relates to preparation of holes for blasting charges and holes for safety rock bolts and netting following a blast and subsequent debris clearing.

This invention still further relates to cutting/igneous geologic material in environmentally sensitive areas such as, but not limited to, for utility trenching, construction foundations, road building, dam building and rescue operations.

BACKGROUND

Conventional methods for drilling holes in rock for the various purposes including, but not limited to, natural gas and oil wells, and the like use a rotary vibratory drill bit (hereinafter "drill bit") and downward pressure interconnected to a length of drill pipe, also called a drill string, which is axially rotated by mechanical apparatus.

The drill bit may be constructed from a variety of materials, such as, but not limited to, tungsten carbide, high strength steels, imbedded diamond cutters, and the like. Drill bits are typically specialized for various rock/strata formations, hereafter referred to as a "stratum". Drill bits, however, "wear out" and/or "break down" during the drilling processes. Replacement of a drill bit requires removal of the drill string and drill bit from the drilled hole. To keep a drilled hole from collapsing inwardly on itself an outer casing may need be installed and perhaps even cemented into the drill hole. Replacing a worn-out, or broken, drill bit is a time and monetarily expensive process, and a source of safety risks.

Chips and rock fragments broken from the stratum, within the hole, by the applied friction and rotation of the drill bit are removed from the drilled hole by pumping "drilling mud", commonly sodium bentonite clay, at high pressure through an axial channel, defined in the drill string, from a surface level downwardly to the bottom of the hole being drilled. The drilling mud exits the drill stem through orifices defined in the drill bit. The high pressure exerted on the drilling mud passing through the drill stem causes the drilling mud, and chips, and rock fragments, to be pushed, moved, and/or floated upwardly along an exterior of the drill stem until the drilling mud and carried rocks/chips exit the drill hole at the point the drill hole was initiated, typically at the surface. The use of drilling mud is to remove rocks/chips from the drilled hole and also to cool and lubricate the drill bit. However, use of drilling mud adds significant cost and complexity to drilling operations, including, but not limited to, the need for water, pumps, filters, shakers and continuous chemical analysis of the drilling mud to maintain appropriate density and viscosity.

Reductions in drilling costs have been achieved by using Electro-Magnetic Radiation, including reducing requirements for drill string removal, drill bit replacement and setting of casings and various drilling fluid requirements.

Rock mechanics, drilling, and Mining using Electro-Magnetic Radiation have been the subject of many Government Managed Laboratory, University, and Industry Trade Group studies, with published papers and related patents granted over the years. Electro-Magnetic Radiation has now been widely and successfully developed for use in the Oil and Natural Gas Industries.

Electro-Magnetic Radiation, hereafter EMR, is effective in enhancing the rate of penetration by conventional drilling by softening and/or breaking the chemical bonds in strata, normally sandstone of limestone, where oil or natural gas is a sought-after material. In "well completion" operations, a large amount of EMR energy is transmitted via a fiber optic cable to penetrate the outer casing and to fracture adjacent strata to create pockets where oil and/or natural gas may migrate and hence enter the outer casing. The oil is often induced to a change in viscosity by the process of pumping steam or hot water into the bore hole, commonly known as "fracking", allowing for the easier extraction of high viscosity oil.

Fracking has been shown to save drilling time while increasing production thus lowering costs.

EMR systems can aid conventional rocket drilling/cutting techniques by softening, spalling, melting, or vaporizing the rock and strata. Spallation is a rock removal process that utilizes a combination of EMR induced thermal stress and EMR induced superheated steam explosions spacedly below the EMR/rock interaction to fracture the rock/strata into small fragments that can easily be removed from the formation. High intensity EMR energy applied to a stratum causes the stratum surface temperature to increase nearly instantaneously. This results in thermal stresses in the stratum subsurface. The EMR energy also nearly instantaneously vaporizes any moisture in the stratum subsurface. The vaporized moisture (steam) creates significant mechanical stresses causing fractures. The EMR spells the stratum into small pieces (chips) which allows the removal of chips with means other than drilling mud.

In underground mining operations, a shaft is a vertical or inclined excavation in rock for the purpose of providing access to an orebody. A shaft is usually equipped with a hoist at the surface, which lowers and raises a conveyance for handling workers and materials. Portals, which are the surface entrances to shafts or edits, which are openings driven horizontally into the earth to provide access to a mineral deposit. Crosscuts, which are horizontal shafts driven from a main shaft at, or near, right angles to a strike or a vein or other orebody. Drifts are horizontal underground openings that follow along the length of a vein or rock formation as opposed to a Crosscut which crosses the rock formation. Stopes are excavations in a mine from which ore is, or has been, extracted following veins of ore. Drifts may be anywhere from about three to twenty plus feet in width and nearly any height the operator chooses, taking into consideration safe mining practices and the capacities and capabilities of available mining equipment.

The face of a drift is ordinarily prepared for blasting by drilling holes, with a "jackleg" pneumatic drill, in a predetermined pattern and to a predetermined depth. The drilled holes are then packed with an explosive media such as a mixture of ammonium nitrate and fuel oil commonly called ANFO. The explosive charges are detonated in a predetermined order to fracture and collapse the strata for removal of the sought-after mineral while preserving, as much as possible, the integrity of the strata and the drift. Stopes are mined upward or downward following the sought-after minerals particularly in narrow vein structure mines.

Drilling and blasting is known to induce or exacerbate "rock bursts" which are sudden releases of energy resulting in the sudden failure of walls, backs, or pillars in a mine, caused by the weight and/or pressure on the surrounding rocks and from residual stresses. These stresses are often a result of prior blasting. Minimizing rock burst requires scaling, which is a process of removing loose slabs of rock from the back and walls of an underground opening. Scaling is commonly performed with a hand-held scaling bar or with a boom-mounted scaling hammer and is followed by rock bolting. Rock bolting is the act of supporting openings in rock with steel bolts, anchored in holes drilled especially for this purpose to stabilize the strata.

Reducing or even eliminating drilling and blasting, minimizes residual stresses and the need for "rock bolting". Mining is thus safer and thus more efficient and less costly.

Mine operators have continued to search for methods of removing sought-after minerals between drifts, particularly in narrow vein situations. Known mining practices employed heretofore to extract such sought-after minerals are effective but require a considerable workforce and expense for the tonnage produced. At present, the difficulties, and costs of mining to even greater depths following down dipping veins has become less profitable and working conditions for the miners more untenable.

Our invention at least partially resolves various of these continuing needs through the use of a Scanhead and an EMR system in a mining array to operate cooperatively. Each Scanhead uses a collimated source of EMR energy in the 0.4-to-4-kilowatt photon power range to thermally fracture and/or spall chips in igneous stratum. The spall chips may be approximately equal in size to the collimated EMR beam diameter and also approximately equal from one half to the full collimated EMR beam diameter in thickness. These chips are often called muck.

Vacuum systems, augers, conveyors, and bucket loaders, often called "muckers" remove mined material (muck) to areas for further processing.

In many narrow vein mines drifts are narrow, only being wide enough for a man-pass therethrough and/or for a narrow-gauge rail system for mucking or ore removal. In contemporary mining operations in narrow vein mines, slabbing is performed to widen passages by drilling and blasting to remove rock from a drift's ribs. "Ribs" are the side of a pillar or side of a wall of an entry. A "back" is the roof or upper part in any underground mining cavity.

Some or all of the problems, difficulties, and drawbacks identified above, and other problems, difficulties, and drawbacks, known and unknown, may be helped, improved, or solved by the inventions described herein. Our invention may also be used to address other problems, difficulties, and drawbacks not set out above or which may be only understood or appreciated at a later time. The future may also bring to light currently unknown or unrecognized benefits which may be appreciated or more fully appreciated, in the future associated with the novel inventions shown and described herein.

BRIEF SUMMARY OF THE INVENTION

A method and apparatus for underground mining using a multi-kilowatt Electro-Magnetic Radiation System, to heat an irradiated stratum, which has been cooled prior to being irradiated and heated, to cause thermal stress fracturing and/or spallation of the stratum which contains sought-after minerals, ores, gemstones, and the like.

A principal aspect of the current method and apparatus for using Electro-Magnetic Radiation in Narrow Vein Mining is generating and delivering a cooling media to a working surface 25, 26, 27 of a geological stratum 11 having a sought after mineral 12 to be removed; generating and delivering an EMR beam of collimated photon energy, focused to infinity to the working surface; moving the EMR beam of collimated photon energy, focused to infinity, about perpendicular axes so that a focal point of the EMR beam of collimated photon energy, focused to infinity, moves across the working surface 25, 26, 27, and rapidly increases the surface temperature of the working surface 25, 26, 27; providing a source of a cooling media, and delivering the cooling media to the working surface 25, 26, 27 so as to rapidly cool the working surface 25, 26, 27 subsequent to the rapid surface temperature increase generated by the EMR beam of collimated photon energy, focused to infinity, so as to effect a fracturing of the working surface 25, 26, 27 and to generate a plurality of spalled chips 63 from the working surface; and removing the spalled chips 63 spalled from the working surface 25, 26, 27.

A further aspect of the current method and apparatus for using Electro-Magnetic Radiation in Narrow Vein Mining is providing a geological stratum having a sought after mineral 12 to be removed; delivering a EMR beam of collimated energy, focused to infinity, to a working surface of the geological stratum 11, and the EMR beam of collimated photon energy, focused to infinity, has a power output which is sufficient to spall small chips of the working surface of the geological stratum 11; moving the EMR beam of collimated photon energy, focused to infinity, 10 along a predetermined path of travel across the working surface, and wherein the delivery of the EMR beam of collimated photon energy, focused to infinity, 10 to the working surface increases the surface temperature of the working surface; providing a source of a cooling media, and delivering the cooling media to the working surface so as to reduce the working surface temperature to a temperature which encourages spalling; removing at least in part, a portion of the spalled chips 63 generated from the working surface; and delivering the removed spalled chips 63 to a remote area.

A further aspect of the current method and apparatus for using Electra-Magnetic Radiation in Narrow Vein Mining is providing a geological stratum 11 having a sought after mineral; 12 providing a working surface 25, 26, 27 of the stratum 11 and upon which the method of mining may be operated; providing a source of compressed air 16, a source of electrical energy 38 and a source of EMR 10; generating an EMR beam with the sources of electricity and the source of EMR 10, which has a photon power sufficient to cause a spelling of the stratum 11 and sought after mineral 12 forming the work surface; providing a flexible cable 20 having a first end portion of the flexible cable 20, and a second end portion, and wherein the first end portion operatively communicates with the source of EMR 10, the source of compressed air 16, and the source of electrical energy 38; delivering the EMR beam to the first end portion of the Flexible Cable 20 for transmission therealong; providing an environmentally sealed Scanhead 22 or an environmentally sealed Drill Head 48 having a first end portion and a second end portion, and wherein the second end portion of the environmentally sealed Scanhead 22 or environmentally sealed Drill Head 48 operatively communicates with the second end portion of the Flexible Cable 20 and further receives the EMR beam from the source of EMR 10, the EMR beam which the Flexible Cable 20 receives, and passes therealong, the compressed air from the source of compressed air 16, and the electrical energy from the source of electrical energy 38; providing a rotating dome 49 at the first end portion of the environmentally sealed Scanhead 22 or environmentally sealed Drill Head 48, and which operatively communicates with the source of EMR 10, through a water cooled fiber optic coupler mated to a water cooled optical collimator which expands the EMR beam to the desired diameter, and focuses the beam to infinity, and wherein the rotating dome 49 of the environmentally sealed Scanhead 11 or environmentally sealed Drill Head 48 has a protective and piano Refractive Window 53 at a first end portion, and plural, internal, Reflective Optical Elements 50 which are located in predetermined spaced relation relative to the protective piano Refractive Window 53 and which are further contained within a body of the environmentally sealed Scanhead 22 or environmentally sealed Drill Head 48, and wherein the plural Reflective Optical 50 elements are individually controllably movable to transmit the collimated EMR beam, focused to infinity, through the protective piano Refractive Window 53, and onto an identified spall area of the work surface, and which is proximate to the rotating dome 49 of the environmentally sealed Scanhead 22 or environmentally sealed Drill Head 48, and wherein the collimated EMR beam, focused to infinity, is moved in a given pattern having a predetermined scanning path, and a predetermined dwell time, so as to cause spalling of the stratum 11 and which generates a multiplicity of spalled chips 63, and removal of the sought after mineral 12 from the spall area; delivering the compressed air to the rotating dome 49 of the environmentally sealed Scanhead 22 so as to both cool the plural internal Reflective Optical Elements 50, and the spall area which is being irradiated by the collimated EMR beam, focused to infinity, so as to thermally control the stratum 11 and sought after mineral 12, and which further promotes the cooling of the spall area while inhibiting the melting and vaporization of the stratum 11 and the sought after mineral 12; removing the spalled chips 63 away from the spall area by the use of the source of compressed air 16; providing a chip removal system having an evacuation port which is proximate to the rotating dome 49 of the environmentally sealed Scanhead 22 for evacuating the spalled chips 63 from the spall area, and for propelling the spalled chips 63 toward the second end portion of the environmentally sealed Scanhead 22, and to a remote location for collection and processing; providing a Transport Vehicle 19 to move the environmentally sealed Scanhead 22 along a predetermined path of travel relative to the work surface, and to further maintain a predetermined desirable distance between the rotating dome 49 of the environmentally sealed Scanhead 22 or environmentally sealed Drill Head 48, and the work surface so as to facilitate effective spalling and the generation of the spalled chips 63; and providing a controller operatively communicating with, and controllably coupled to the environmentally sealed Scanhead 22 or environmentally sealed Drill Head 48, the drive unit, the source of EMR 10, the source of compressed air 16, the source of electrical energy 38, and the chip removal system, and wherein the controller is located remotely relative to the environmentally sealed Scanhead 22 or environmentally sealed Drill Head 48, and further controls the operation of the environmentally sealed Scanhead 22 or environmentally sealed Drill Head 48, the delivery of the compressed air, and the removal of the spalled chips 63 by way of the removal system.

A further aspect of the present invention is a method and apparatus for drilling a predetermined pattern of predetermined depth holes for the placement of explosive charges and/or for placement of rock bolts.

A further aspect of the instant method and apparatus for underground mining is using a collimated EMR beam, focused at infinity, to cause thermal stress fracturing or spallation. This method includes the steps of generating and delivering a cooling media to a working surface so as to rapidly cool the working surface, and also the step of generating and delivering a defined diameter EMR beam to the cooled work surface of underground geological strata; moving the EMR beam about plural axes so that the EMR beam diameter moves across the cooled work surface in a predetermined pattern with predetermined pauses to rapidly increases the temperature of the illuminated spot on the working surface so as to generate thermal fracturing of the working surface and to generate a plurality of chips from the working surface, a second application of cooling media may be provided to post cool the surface and to aid in the removal of the spalled chips.

A still further aspect of the instant method and apparatus for underground mining is using a collimated EMR beam, focused to infinity, to cause thermal stress fracturing or spallation which includes the steps of providing a geological strata having a sought after mineral, ore, or gemstone to be removed; providing a photon power output which is sufficient to thermally stress fracture or spall small chips of the working surface of the geological strata; moving the collimated EMR beam, focused to infinity, along a predetermined path of travel across the working surface and wherein the delivery of the collimated EMR beam focused to infinity, upon the working surface increases the temperature of the working surface; providing a source of cooling media and delivering the cooling media to the working surface to cool the working surface temperature below a temperature which encourages spallation; removing, a portion of the thermally stress fractured or spalled chips from the working surface; providing a chip collection and transport means; and delivering the collected spalled chips to a second area for further processing.

An even still further aspect of the instant method and apparatus for mining using a collimated EMR beam, focused to infinity to cause thermal stress fracturing or spallation includes the steps providing a geological stratum having a sought after mineral, ore or gemstone, providing a working surface of the stratum and upon which the method of mining may be operated; providing sources of conditioned compressed air, electrical energy, and EMR; generating a collimated EMR beam, with sources of electricity and cooling media, the generated collimated EMR beam, having a photon power sufficient to cause a thermal stress fracturing or spallation of the stratum forming the work surface; providing a fiber optic cable having a first end portion and a second end portion and where the first end portion of the fiber optic cable operatively communicates with the source of EMR, delivering the generated EMR beam to the second end of the fiber optic cable wherein the second end portion of the fiber optic cable communicates with a water-cooled fiber optic coupler and a water-cooled optical collimator which expands and focuses the EMR beam to infinity and with a first end of a Scanhead that receives the EMR beam; providing a flexible hose having a first end portion and a second end portion and wherein the first end portion of the flexible hose operatively communicates with a source of conditioned compressed air and which delivers the conditioned compressed air to the scanhead; a flexible cable having a first end portion and a second end portion and wherein the first end of the flexible cable operatively communicates with a source of electric energy; and with a source of servo control signals through proprietary software; providing the environmentally sealed scanhead a source of servo control signals having controlling software; and wherein the scanhead contains a motor to rotate a dome of the scanhead; and wherein the motor is of an inside out design (rotating stator inside, stationary rotor outside); and a resolver that monitors the speed and position and rotation of the motor; and wherein a slip ring unit transfers electrical energy to the motor; and wherein servo control signals are passed to a servo control system to the motor; and wherein the dome encloses a movable protective piano refractive window, and plural, internal, reflective optical elements are located within the scanhead in predetermined spaced relation relative to the protective piano refractive window and which are further contained within a body of the scanhead and wherein two of the reflective optical elements are individually controllably movable to transmit the EMR beam through the protective piano refractive window and onto an identified thermally fracturable or spallable area of the work surface, which is proximate to the scan head and wherein the collimated EMR beam is moved in a predetermined pattern having a predetermined path and a predetermined dwell time so as to cause thermal fracturing and/or spalling of the stratum which generates a multiplicity of spalled chips; delivering compressed air to the scanhead to both cool the internal reflective optical elements, and to clean the protective piano refractive window, and to clear previous spalled chips and to thermally control the irradiated work surface area subsequent to irradiation by the focused EMR beam so as to thermally control the stratum and sought after mineral, and which further promotes the cooling of the spall area while inhibiting the melting or vaporization of the stratum and sought after mineral; removing spalled chips from the spall area using the compressed air; providing a chip removal system having an auger system for gathering spalled chips to a central location; and for forwarding the collected spalled chips to a predetermined location for further removal; and providing an apparatus to activate the auger system; and providing a cable with a first end and a second end to provide a source of electrical energy to activate the auger mechanical apparatus.

It is to be understood that many of the individual components described in this system are commercially available and used as intended, other components are modified and customized for the particular purposes of the devices described herein while other components are unique and designed specifically for applications in this device.

Other and further aspects of our invention will appear from the following specification and accompanying drawings which form a part thereof. In conducting the aspects and objects of our invention it is to be understood that its structures and steps are susceptible to change in design and arrangement and order with only one embodiment being illustrated in the accompanying drawings and specified as required.

BRIEF DESCRIPTIONS OF THE FIGURES

Disclosed forms, configurations, embodiments and/or diagrams relating to or helping to describe aspects and versions of our inventions are explained and characterized herein, often with reference to the accompanying drawings. The drawings and features shown herein also as part of the disclosure of our invention, whether described in text or merely by graphical disclosure alone. These drawing are briefly described below.

DETAILED WRITTEN DESCRIPTION OF THE PREFERRED EMBODIMENTS

Figure 1:
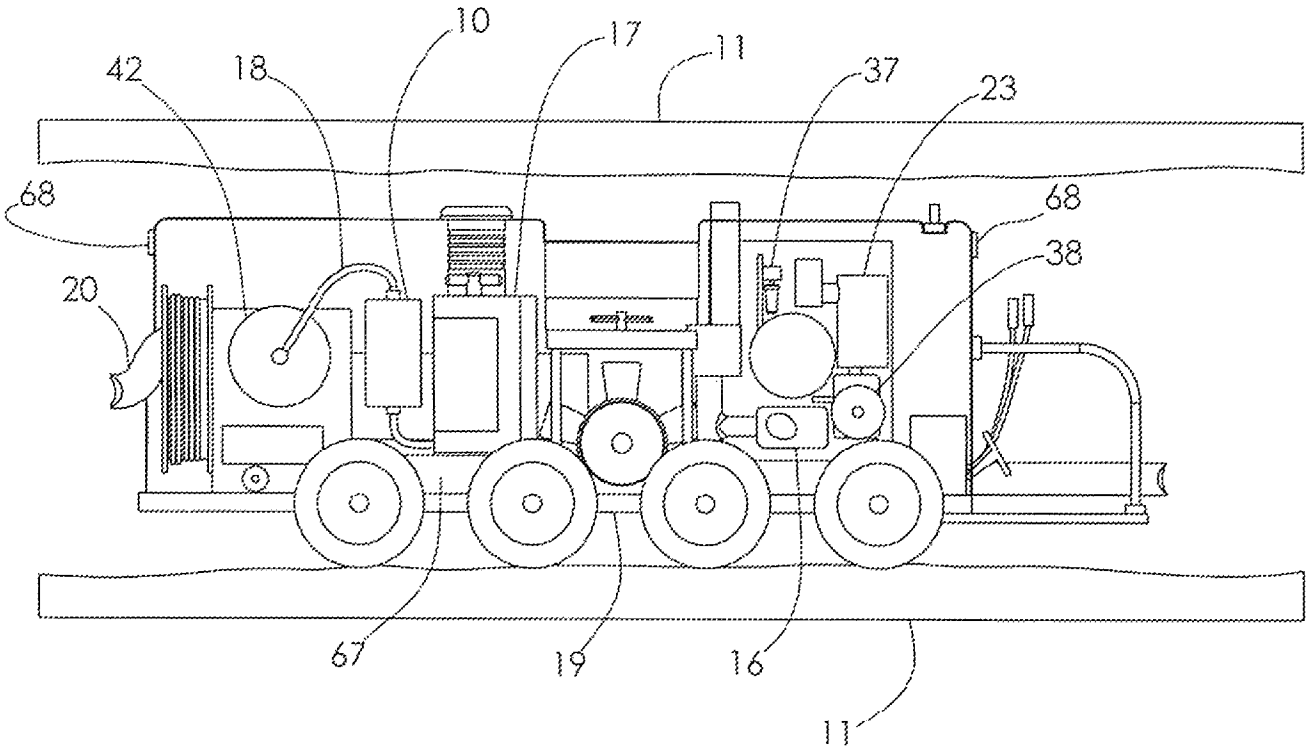
FIG. 1 is an orthographic side view of one contemplated embodiment of a primary transport vehicle showing contemplated locations of each of the components of the present invention.

Dictionaries were used in the preparation of this document. Widely known and used in the preparation hereof are *The American Heritage Dictionary of the English Language,* 4th Edition (© 2000), *Webster's New International Dictionary*, Unabridged, (Second Edition ©1957), *Webster's Third New International Dictionary* (© 1993), *The Oxford English Dictionary* (Second Edition, © 1989), The New Century Dictionary (©2001-2005), and *Glossary of Mining Terms* (sec.gov/Archives.edgar/data/1165780/000116578003000001/glossary.htm) all of which are hereby incorporated by this reference for interpretation of terms used herein and to more adequately or aptly describe various features, aspects and concepts shown or otherwise described herein using words having meanings applicable to such features, aspects, and concepts.

This document is premised upon using one or more terms with one embodiment that may also apply to other embodiments for similar structures, functions, features, and aspects of the inventions. Wording used in the claims is also descriptive of the inventions, and the text of both claims and abstract are incorporated by this reference into the description entirely.

Our method and apparatus for using Electromagnetic Radiation, hereafter EMR 10 in narrow vein mining to cause spalling or thermal fracturing of a geological stratum 11 containing sought after mineral 12 which may be in the form of a vein, 13 or in the form of an ore 14 or in the form of a gemstone 15 in an underground mining location, generally comprises a source of compressed air, 16 a source of electrical energy, 38 a source of EMR, 10 a Liquid Chiller 17; a Fiber Optic Cable, 18 an equipment Transport Vehicle, 19 a flexible Electrical Cable, 20 a Robotic Arm, 21 a Scanhead 22 for beam steering, and a Servo Control System 23 with a user interface for remote operation; and software 24 to control operations.

A working surface 30 of the geological stratum 11 containing a sought-after mineral 12 and/or gemstone 15 is identified, and may be without limitation, a vertical surface 25, a horizontal surface 26, or an angulated surface 27 and further maybe located, without limitation, within a mine shaft 28, a mine drift 29, a mining stope 30, or any surface containing the sought-after minerals 12 or gemstones 15. As noted previously, the sought-after mineral 12 which may include, but not be limited to, gold 30, silver 31, platinum 32, and the like may be in the form of a vein 13 within the stratum 11 or may be in the form of an ore 14. A sought-after mineral 12 may also be in the form of diamond 34, emerald 35, red beryl 36, or another precious gemstones 15. (Collectively sought-after materials 12).

The Transport Vehicle 19 may have a variety of configurations, but in the disclosed embodiment has moving means, such as, but not limited to, wheels and/or tracks and may be powered by known means such as diesel fuel, LNG, and/or electricity, and may also carry the source of compressed air 16, an air filtration system 37, the source of electrical energy 38, the source of EMR 10, the liquid chiller 17 and a secondary Servo Control System. 23. The source of EMR 10 is preferably a ytterbium doped, diode pumped, Fiber Laser 10 using a deionized liquid chiller 17 for thermal control, a Fiber Optic Coupler 39, and a cooled Optical Collimator 40. The Fiber Laser 10 will preferably operate in a power range of approximately 1.0 kW to about 4.0 kW, and more preferably operate between about 0.4 kW and 3.0 kW. EMR levels and dwell time are dependent on stratum types and compositions.

Transport of the components including, but not limited to, the source of compressed air 16, the source of electrical energy 38, the source of EMR 10, the servo controller 23 by the Transport Vehicle 19 allows presently disclosed method and apparatus of mining to be moved from location to location providing portability and maneuverability and ease of setup. Depending upon the type of mining to be performed, the several types of Transport Vehicle 19 may also include a Crane 41 mechanism having a variety of Cable Spools 42 so as to efficiently and effectively store a length of the Flexible Cable 20 which allows for raising and lowering of a Mining Array 43 having one or more Scanheads 22.

The Transport Vehicle 19, the source of compressed air 16, the source of electrical energy 38, the source of EMR 10, and the Servo Control System 23 may all be operated by an operator of the Transport Vehicle 19 which allows the operator to be located remotely from the actual mining operation and the work surface which promotes worker safety.

Remote location of the operator enhances safety because, among other benefits, personnel need not be subjected to/exposed to noise, smoke, vapors, fumes, gases, and rock bursts and the like that may be generated during mining operations.

The Flexible Cable 20 which has a first end portion, and a second end portion may be carried on a Cable Spool 42. The Flexible Cable 20 defines multiple individual internal conduits extending from the first end portion to the second end portion so that pressurized air from the source of pressurized air 16, electricity from the source of electrical energy 38, and cooling medium, such as conditioned chilled water from the source of chilled liquid 17, and other resources may be transmitted there-along from the first end portion to the second end portion. The multiple individual internal conduits may be hollow, such as for passage of liquid or gaseous materials, or the like, therethrough, or the individual conduits may be solid (optical fiber, or wire, or the like) such as for passage of light or electricity therethrough. It is further contemplated the Flexible Cable 20 also includes shielding to protect the individual conduits and the contents thereof flowing or otherwise passing therethrough, from materials passing through adjacent conduits.

A high-power water-cooled Fiber Optic Coupler 39 is carried at the first end portion of the fiber optic cable 20 and also at the second end portion of the individual conduit transmitting/carrying the EMR beam to provide operable interconnections with the source of EMR 10, at the first end portion, and an operable interconnection through the water-cooled Optical Collimator 40 with the Scanhead 22 at the second end portion. High power water-cooled Fiber Optic Couplers 39 and water-cooled Collimators 40 are known in the industry and are commercially available from various manufacturers.

The Scanhead 22 is environmentally sealed and is operatively interconnected to the second end portion of the flexible cable. 20 The high-power water-cooled Fiber Optic Coupler 39 interconnects the conduit transmitting the EMR beam with a water-cooled Optical Collimator 40 carried within the Scanhead 22. The Scanhead 22 may be positioned remotely from the Transport Vehicle 19 utilizing a multi-axis manipulable Robotic Arm 21 (See FIGS. 8 through 12) on a dedicated framework or suspended on a cable set containing necessary connections. The Scanhead 22 receives the generated EMR beam, electricity, chilled water, and pressurized air through various conduits of the Flexible Cable 20.

Between the Transport Vehicle 19 and the Robotic Arm 21 is a first end series of interleaved rectangular metal plates 44 (See FIG. 9) formed in a concave shape each of which has a pneumatically inflatable bladder 45 attached to expand interleaved plates to and primarily act as a first safety shield for reflected EMR energy, and forming a dust and debris seal from thermally fractured or spalled material, a second surface created by a series of inflation chambers expanding the metal plate surfaces to roughly conform to the aperture of the drift (work surface) being thermally fractured or spalled by the EMR system and has a diffused surface to scatter and reflect stray EMR energy back to the surface being illuminated by the EMR effectively reducing the power of the EMR with each return reflection.

The manipulable Robotic Arm 21 consists of a five-axis controlled movement arm with the detachable Elevation Cradle 46 mounted to the Transport Vehicle 19. A Servo- Controlled Motor/Gearhead 47 drives the elevation axis cradle 46 which has mounted a four-axis arm, generally in a square configuration, with a first end portion consisting of a first pivot point, with limited horizontal movement, which is driven through a predetermined angle by a Servo-Controlled Motor/Gearhead 47. A second pivot point, at a predetermined distance from the first pivot point, with limited vertical movement, which is driven through a predetermined angle by a Servo-Controlled Motor/Gearhead 47. A third pivot point, at a predetermined distance from the second pivot point, with limited horizontal movement which is driven through a predetermined angle by a Servo-Controlled Motor/Gearhead 17 counteracts the movement of the first pivot point. A fourth pivot point at a predetermined distance from the third pivot point, with limited vertical movement which is driven through a predetermined angle by a Servo-Controlled Motor/Gearhead 47 counteracts the movement of the second pivot point. The Scanhead 22 or Drill Head 48 including cables and hoses is attached to the second end of the manipulable Robotic Arm 21 through a transition joint.

Figure 2:
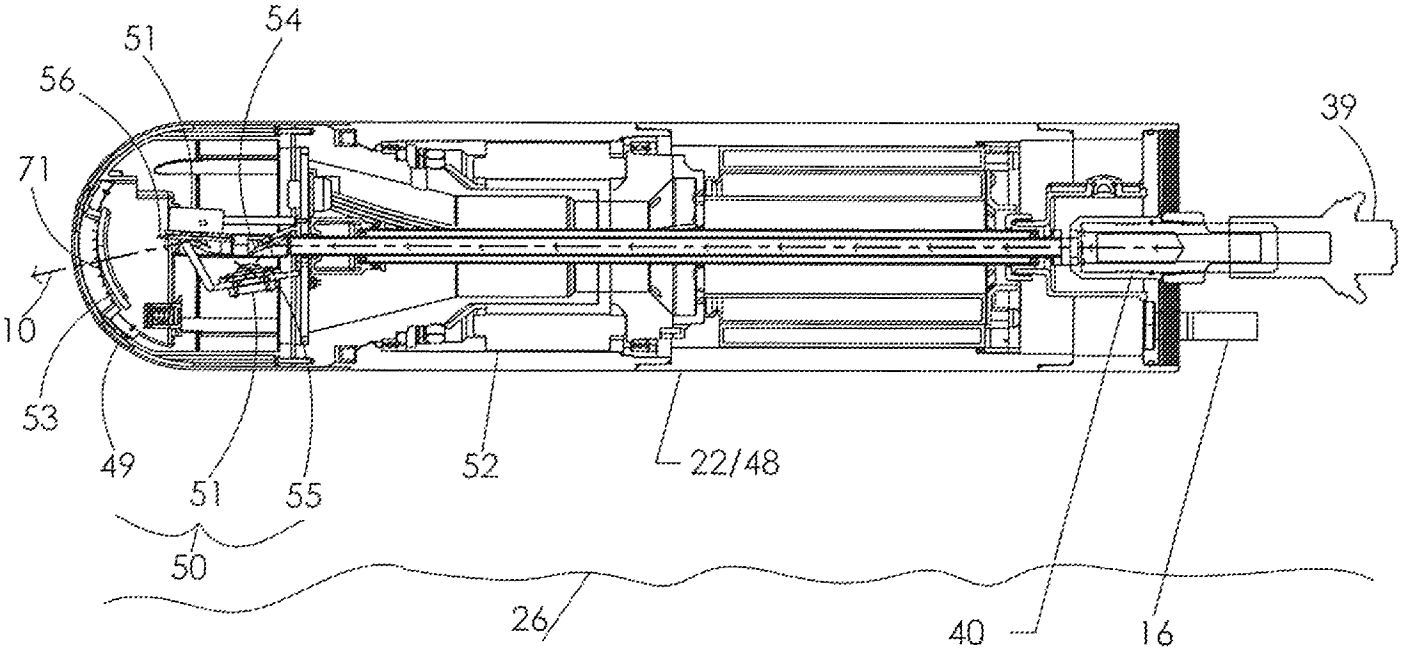
FIG. 2 is an orthographic cross section view of a Scanhead showing the internal components thereof.
Figure 3:
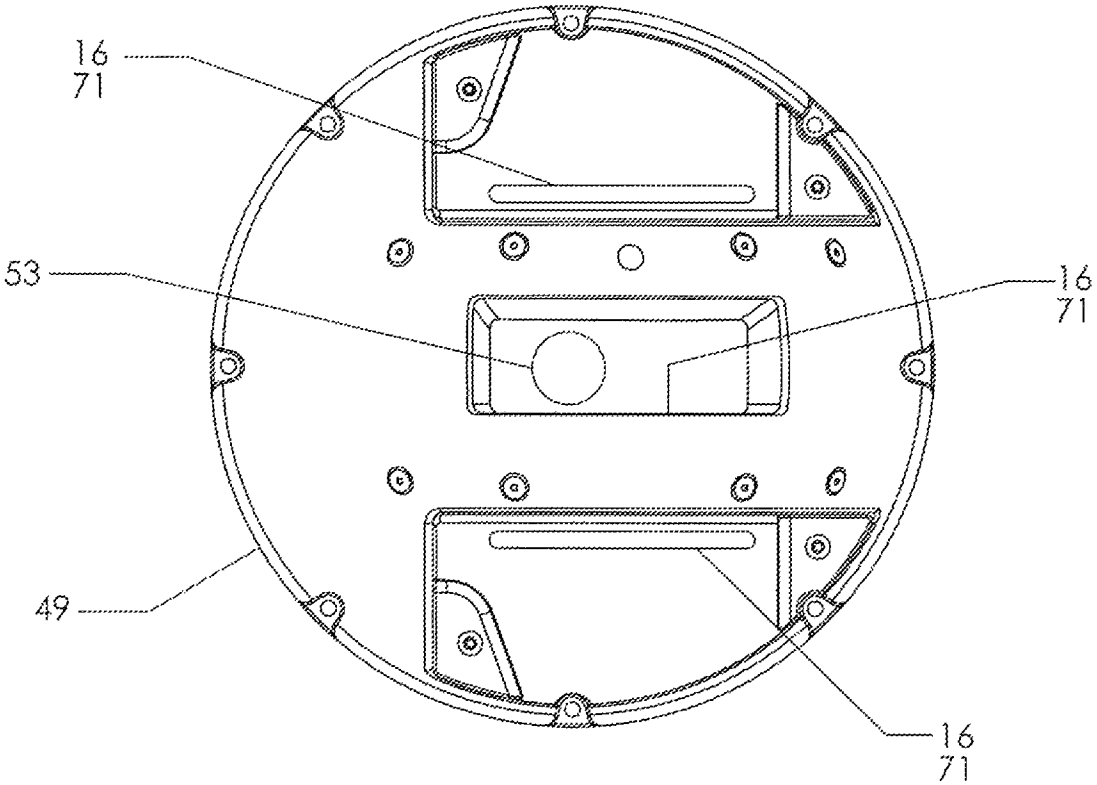
FIG. 3 is an orthographic front view of the Scanhead rotating dome showing the refractive window and cooling air ducting vents.

As shown in FIG. 2 the Scanhead 22 has a body which is generally somewhat cylindrical in configuration. The Scanhead 22 body has a Rotating Dome 49 at a second end portion. The Flexible Cable 20 and high-power water-cooled Fiber Optic Coupler 39, coupled with the water-cooled Optical Collimator 40, interconnect with the first end portion. The Rotating Dome 49 of the Scanhead 22 rotates axially relative to the first end portion at a circumferentially extending joint. The body defines an interior chamber and carries within the interior chamber, plural spacedly arrayed and individually controllably movable Reflective Optical Elements 50, a generated EMR beam 10 through a water-cooled Optical Collimator 40, plural Azimuth Drives 51, a cooling channel as well as other various operating components including known electronics, pneumatic plumbing, and connections, therefore.

Figure 4:
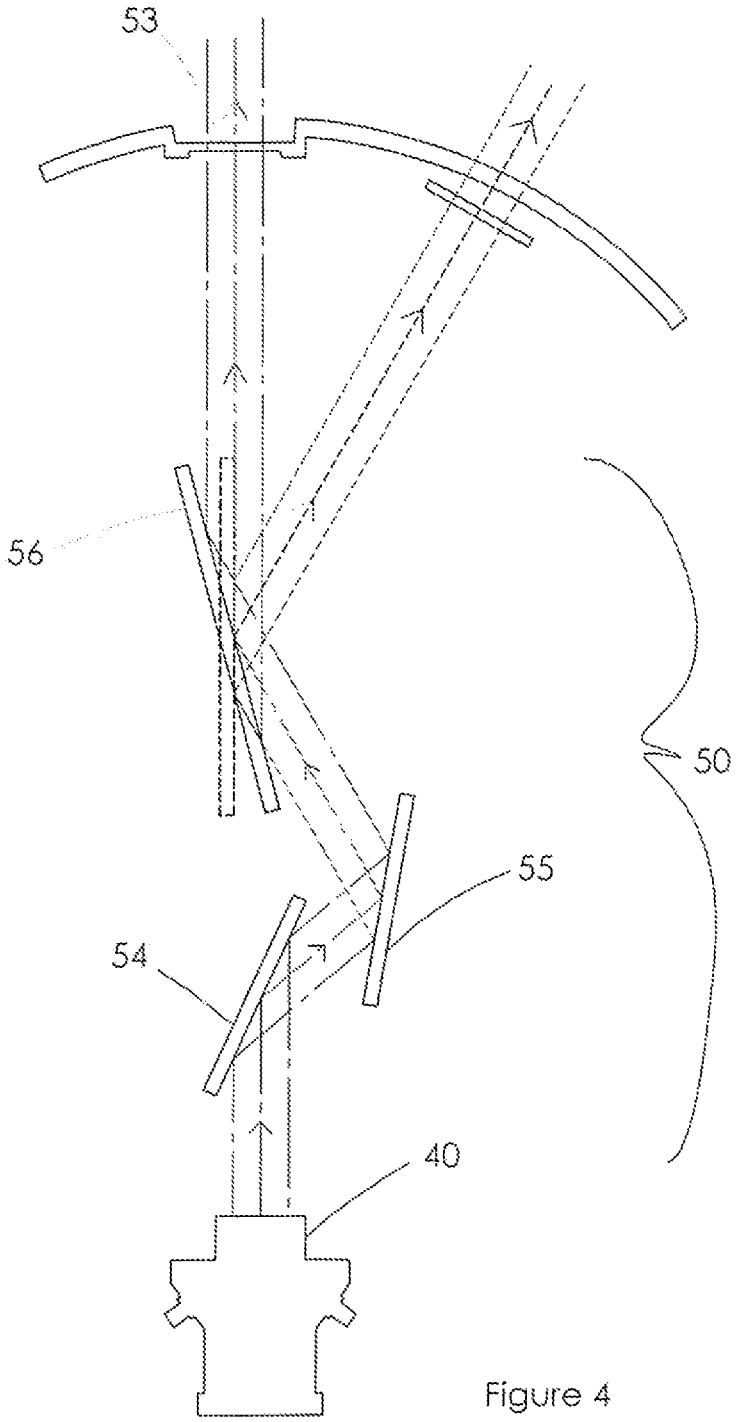
FIG. 4 is an optical schematic showing the orientation of the optical elements within the Scanhead with dashed lines showing direction, and reflections of the EMR.
Figure 5:
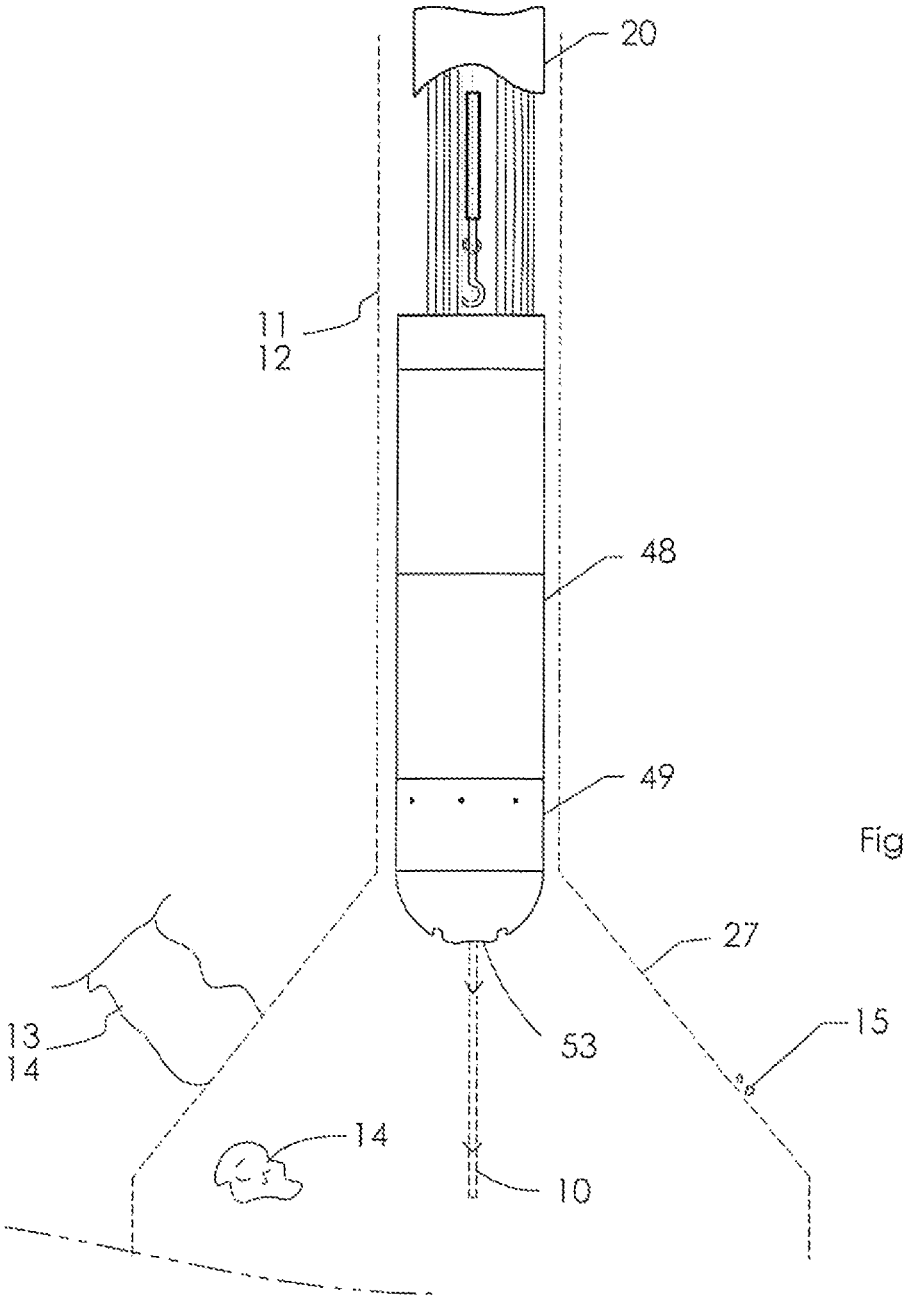
FIG. 5 is an orthographic artistic representation of the present invention being used mining a Raise or Winze with the Scanhead carried at an end of a cable.
Figure 6:
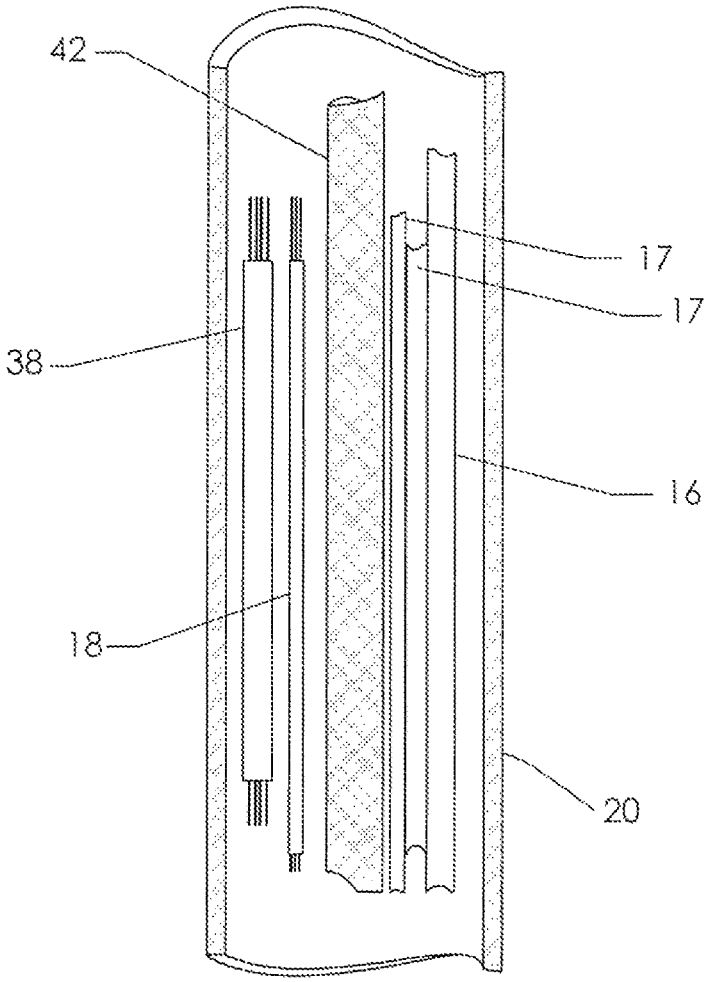
FIG. 6 is a cross section view of a portion of the flexible cable showing internal components thereof.
Figure 7:
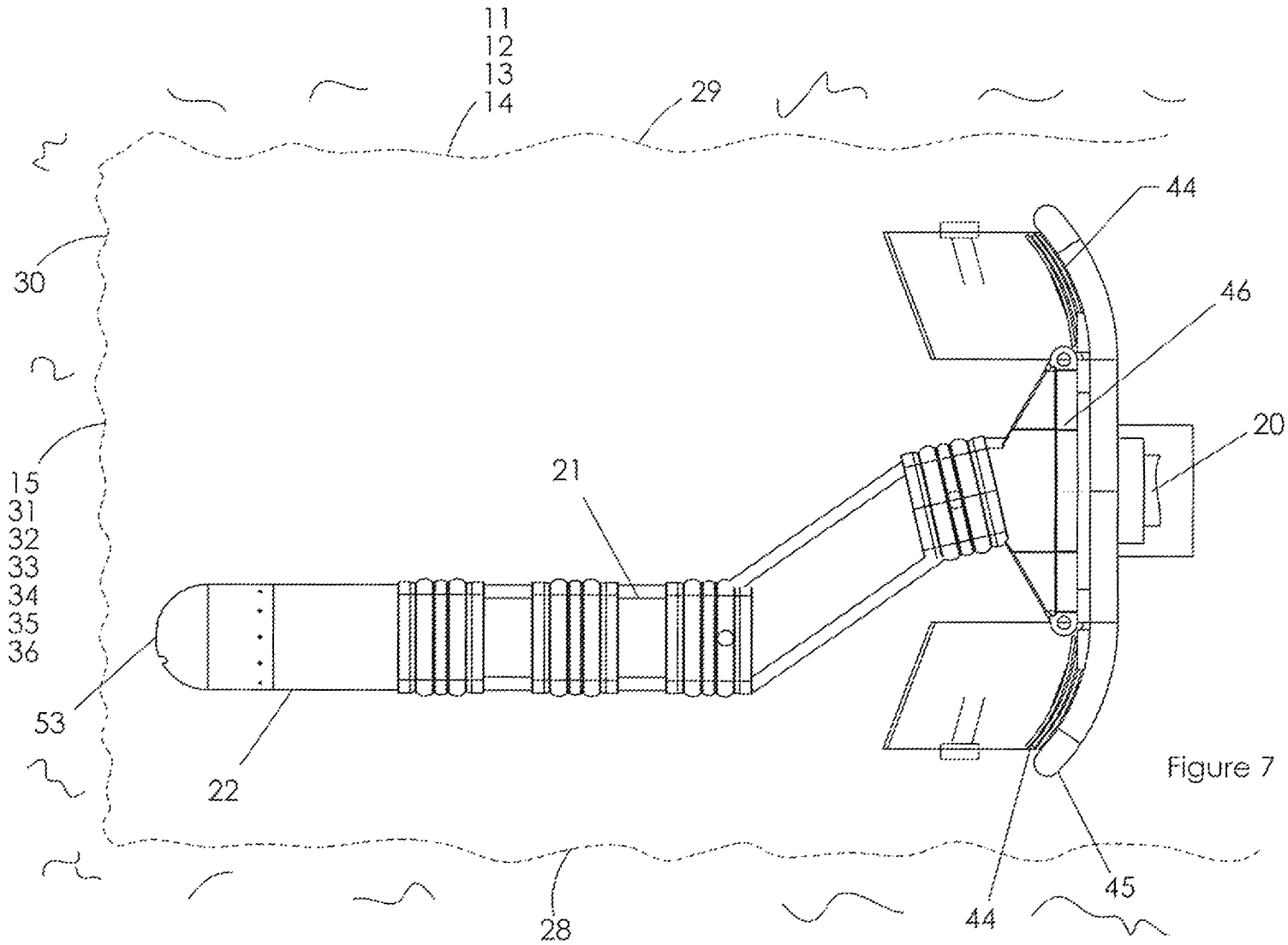
FIG. 7 is an orthographic side view of a Scanhead mounted on one embodiment of a positionally manipulable robotic arm.
Figure 8:
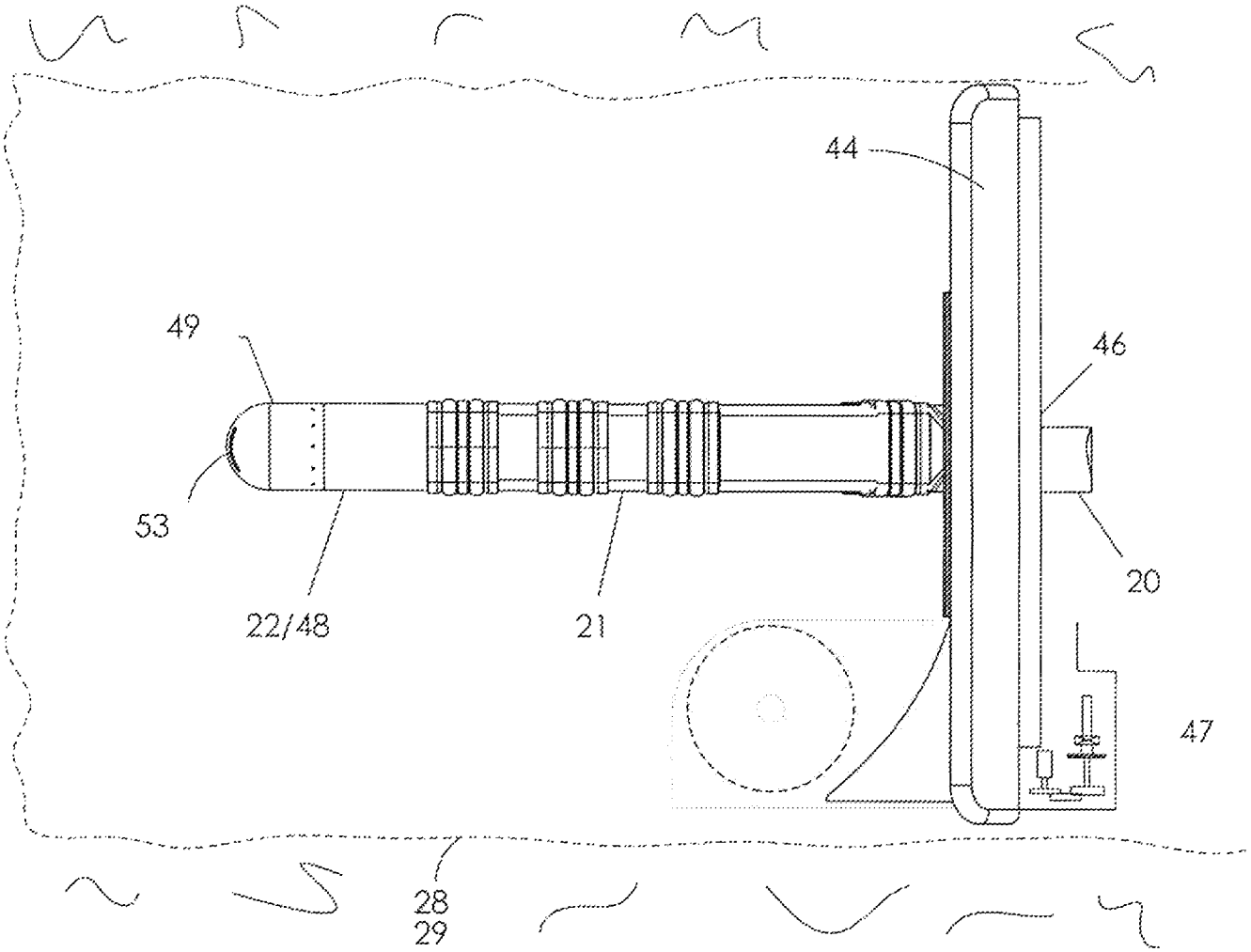
FIG. 8 is an orthographic side view of a Scanhead mounted on a second embodiment of a manipulable robotic arm.
Figure 9:
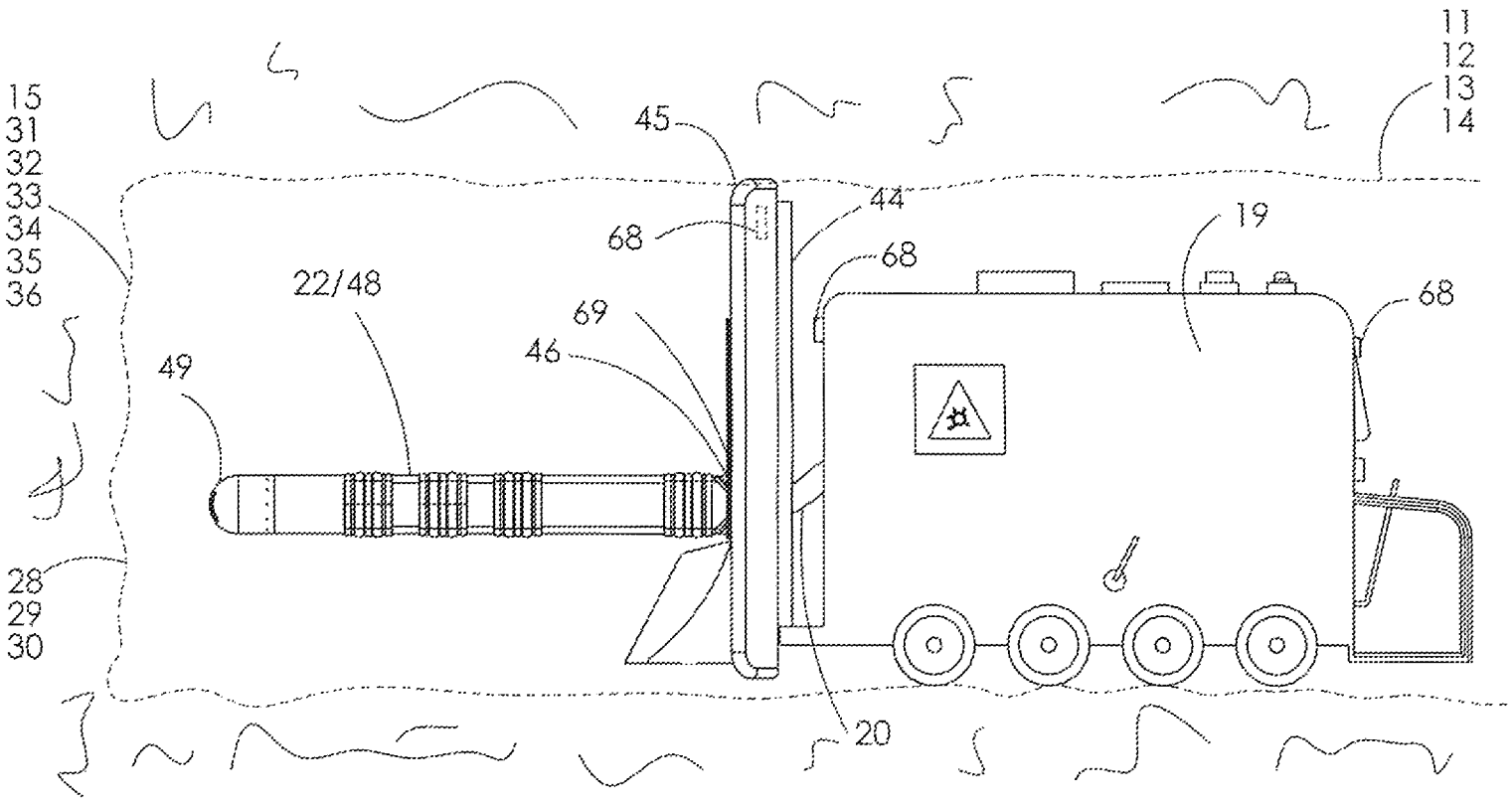
FIG. 9 is an orthographic side view of a Scanhead mounted on a manipulable robotic arm showing the relationship with one embodiment of a transport vehicle.
Figure 10:
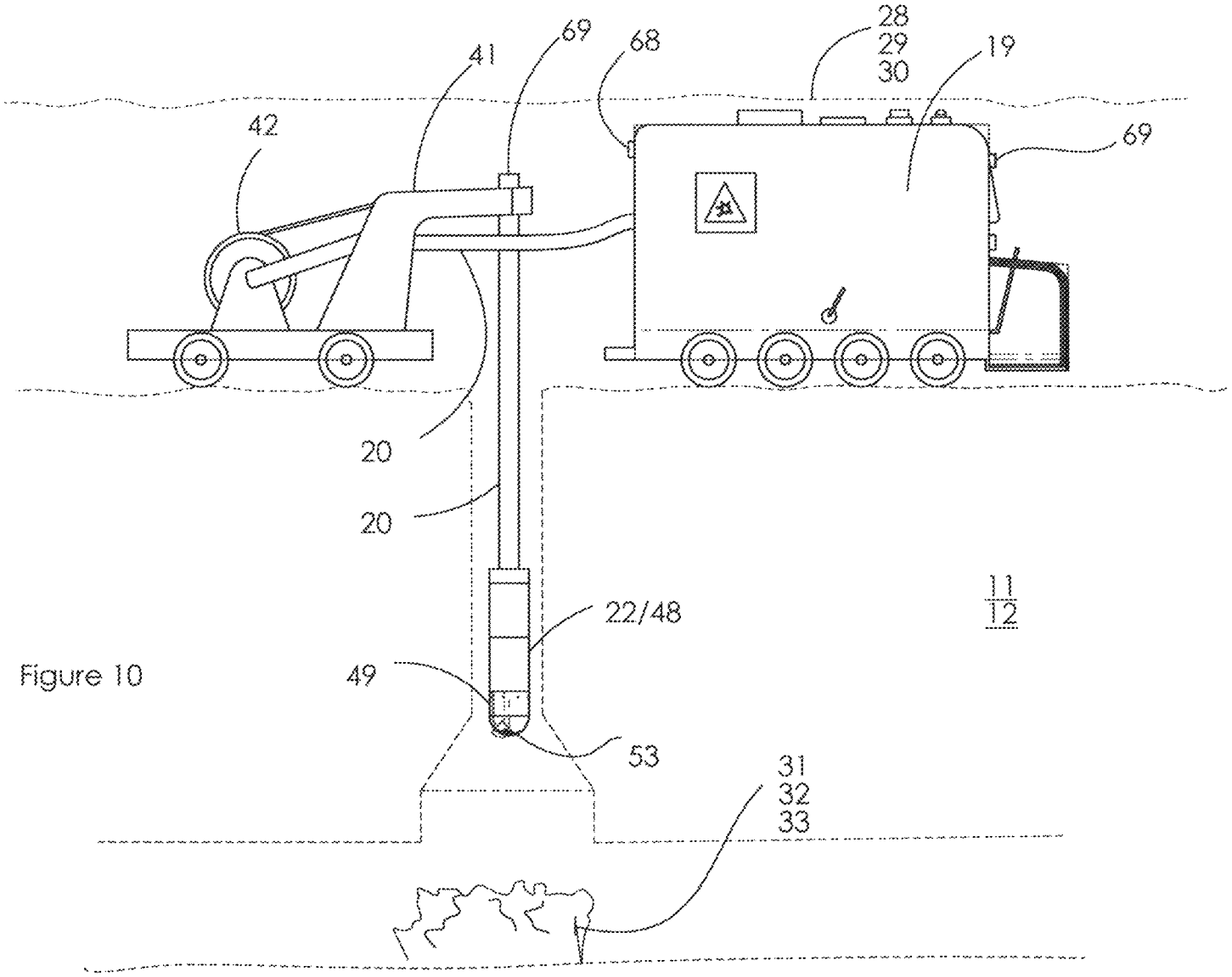
FIG. 10 is an artistic representation of one possible configuration of a Scanhead and an auxiliary cart used when mining a raise or winze.
Figure 11:
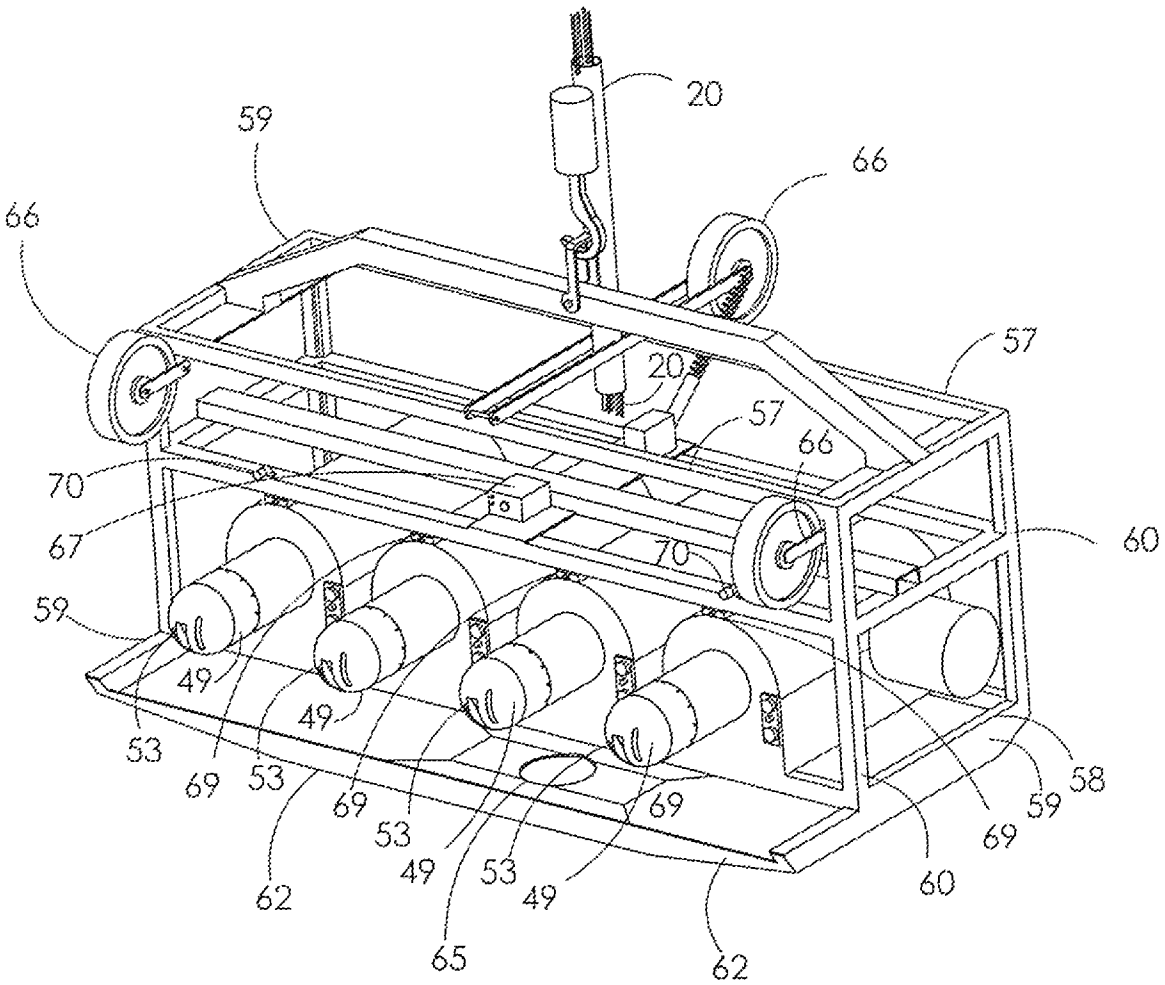
FIG. 11 is a perspective view of one embodiment of a mining array having plural Scanheads.
Figure 12:
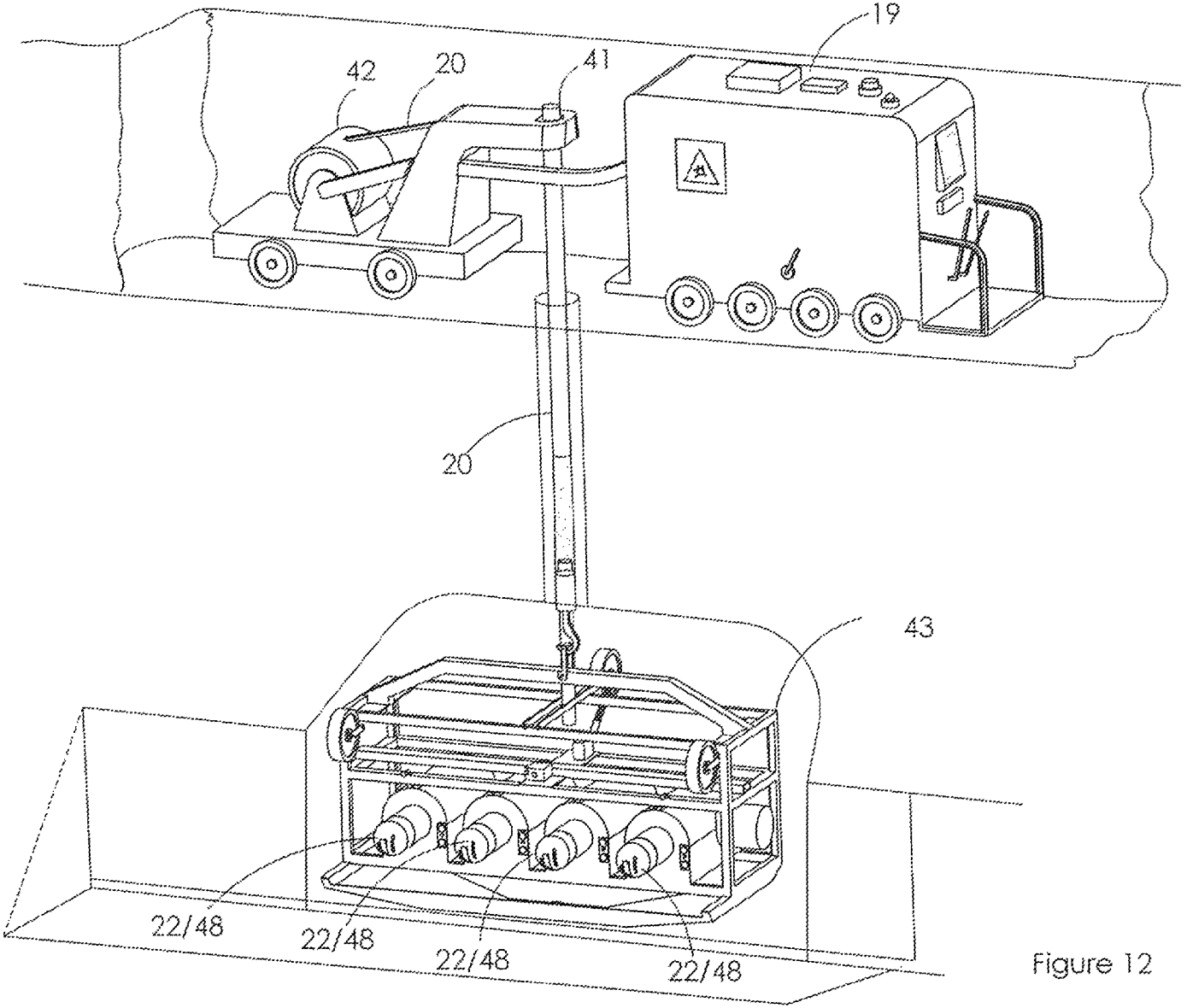
FIG. 12 is an environmental perspective view of an enlarged mining array, as shown in FIG. 11, and an auxiliary cart and transport vehicle.

The rotating dome 49 is rotated in azimuth by a rotating means such as, but not limited to, a servo controlled direct drive DC Torque Motor 52 which, when energized, causes the rotating scanning head to rotate and counter rotate axially relative to the first end portion. Rotation of the Dome 49 of the Scan head 22 allows spall area to be a hemispherical shape. A protective piano Refractive Window 53 is carried at a second end portion of the Dome 49 of the Scan head 22 opposite the Flexible Cable 20 and forms a barrier through which the EMR beam may pass from the plural internal Reflective Optical Elements 50 to the spall area of the work surface Best shown in FIG. 4, the plural Reflective Optical Elements 50 include a Folding Optical Element 54, an Oscillating Optical Element 55, and a Scanning Optical Element 56, all of which are mounted at predetermined locations and are movable on servo-controlled Azimuth Drives 51 each of which allow a programmed pattern of travel. The servo-controlled Azimuth Drive 51 operatively communicates with, and are controlled by, the Servo Control System 23 and user interface. Each of the Reflective Optical Elements 50 is comprised of a highly reflective dielectric coating, based on EMR wavelength, deposited on a thermally stable substrate. The highly reflective coatings are not normally commercially available because the formulation of the highly reflective coating is a proprietary trade secret of the Optical Element provider.

The physical positioning of the plural internal Reflective Optical Elements 50 within the interior chamber of the Scanhead 22 is such that the Folding Element, 54 which has the highly reflective surface, receives the collimated EMR beam from the EMR water-cooled Optical Collimator. 40 The EMR beam strikes the highly reflective surface of the Folding Optical Element 54 and is reflected therefrom to the Oscillating Optical Element 55 which similarly has a highly reflective surface thereon. The Oscillating Optical Element 55 is capable of oscillating at an adjustable rate to deviate the EMR collimated beam by approximately one beam diameter. The collimated beam received by the Oscillating Optical Element 55 is thereafter reflected, from the reflective surface to the Scanning Optical Element 56 which similarly has a highly reflective surface thereon. The Scanning Optical Element 56 is movable about an axis so as to provide an elevation arc at a predetermined angle as appropriate for the working face. The elevation arc of the Scanning Optical Element 56 is controlled by an Azimuth Drive 51, the Servo Control System 23 and software. Movement of the Scanning Optical Element 56 causes the collimated EMR beam to move back and forth about a predetermined elevation arc. The Scanning Optical Element 56 is positioned spacedly adjacent inward of the protective piano Refractive Window 53 and within an interior chamber of the Dome 49 portion of the Scanhead 22 so that the EMR beam reflecting off of the Scanning Element 56 is transmitted/passed through the protective piano Refractive Window 53 and onto the work surface where the collimated EMR beam irradiates the stratum 11 within the spall area. Rotation of the Dome of the Scanhead 22, which includes the protective piano Refractive Window 53, in combination with the back-and-forth scanning of the collimated EMR beam along the elevation arc caused by the movement of the Scanning Element 56 causes the collimated EMR beam to irradiate a generally circular area which is the spall area. Within the spall area, the collimated EMR beam irradiates the stratum 11 and causes instantaneous heating of the stratum 11 which results in thermal fractures, instant vaporization of moisture and spalling which causes the work surface to spall stratum 11 or thermally fracture and break chemical and/or thermal bonds within the stratum, 11 forming small fragments, pieces and spalled chips 63 which may be approximately the diameter of the projected collimated EMR beam and to a depth approximately equal to the diameter of the collimated EMR beam. Rapid movement of the collimated EMR beam across and about the spall area with a predetermined path, predetermined time, and predetermined dwell time of the collimated EMR beam 10 generates instantaneous heating and resultant thermal fracturing of the stratum 11 while minimizing vaporization and melting of the stratum 11 and/or melting/vaporization of the spalled chips 63 which would lead to destruction and loss of the sought-after material, particularly gemstones.

An outside air curtain channel and a mine face cooling channel are separately defined within the medial chamber of the Scanhead 22. The mine face cooling channel receives pressurized air from the source of compressed air 16, which may be located on the Transport. Vehicle 19, which is delivered to the Scanhead 22 through one of the conduits defined in the Flexible Cable 20. The air curtain cooling channel defines plural cooling orifices within the medial chamber so that pressurized air may be directed about and upon each of the plural internal Reflective Optical Elements 50 as well as the outer Refractive Window 53 to provide cooling thereto and thermal control thereof. An air curtain orifice 71 is defined in the rotating portion of the Scanhead 22 proximate to the protective piano Refractive Window 53. The air curtain orifice 71 is configured into a frame portion of the piano Refractive Window 53 so as to direct pressurized air emitted from the air curtain orifice to form an air curtain over and about an exterior surface of the protective piano Refractive Window 53. The air curtain protects the piano Refractive Window 53 from dust, debris, spalled chips 63 and the like generated from the spalling. The air curtain simultaneously "pushes" the spalled debris and spalled chips 63 away from the work surface and also cools the exterior surface of the piano Refractive Window 53 and the work surface. The air curtain orifice 71 pneumatically communicates with the mine face cooling channel and likewise with the source of compressed air 16 which is located remotely from the Scanhead 22.

Maintaining a predetermined desirable distance between the rotating portion of the Scanhead 22 and the spall area facilitates effective performance of the EMR drill by maintaining an infinite focal length collimated EMR beam which projects the EMR beam photon energy onto the spall area surface. The predetermined distance is contemplated to be between approximately 30 cm and 60 cm, and more preferably between approximately 7.5 cm and 25 cm.

As chips are spalled from the work surface spall area and/or the borehole increases in depth, the Scanhead 22 is advanced forwardly, by movement of the equipment Transport Vehicle 19 to continuously maintain the predetermined desirable distance between the Rotating Dome 49 of the Scanhead 22 and the spall area.

When employing the Drill Head 48 embodiment of the Scanhead 22, a similar manipulable Robotic Arm 21 is employed with a differently programed Servo Control System. 23 This system is to augment the scan angle of the Rotating Dome 49 of the Drill Head 48 which is utilized as an alternative to the Scanhead 22 utilized in the Drift Miner 43 (mining array) embodiment. (See FIG. 11). The plurality of axes in the Robotic Arm 21 are reprogramed to move to their maximum mechanical limits when desired.

The Drill Head 48 embodiment is intended to drill a predetermined diameter hole to a predetermined depth to allow for the placement of charges or for the installation of safety rock bolts. To achieve these results an ytterbium doped, diode pumped, Fiber Laser, hereafter EMR 10, or similar device, which produces a predetermined EMR photon power that melts and/or vaporizes the selected identified stratum to produce the desired hole size to the depth desired. Typically, the EMR photon beam diameter is less than the desired area to be melted/vaporized. To achieve the desired coverage, an Oscillating Scan System is utilized which in turn causes the size of the pointing elements to be increased through the introduction of a horizontal axis to the oscillating optical element 55 and to the scanning optical element 56 thereby causing the size of the protective piano Refractive Window 53 to increase. To keep the protective piano Refractive Window 53 within manufacturing limits, it is desirable to move/manipulate the piano Refractive Window 53 in concert/conjunction with the EMR beam diameter produced by the oscillating scan system. To achieve the large scan angles needed for drilling, and for rock bolt placement, and mechanical considerations including a sliding piano refractive window frame and tilt of the vertical sections of the Robotic Arm 21 are employed.

A further use of the Drill Head 48 configuration is for forming blast holes of a predetermined pattern and to a predetermined depth, such as for subsequent packing with appropriate charges of explosives (AMFO) that are detonated in a predetermined time sequence. Such patterns and depths are well known and used by mining engineers, and therefore are not more fully described herein.

In a further contemplated embodiment, plural Scanheads 22 may be carried upon a Mining Array 43, (See FIG. 11) as disclosed in U.S. Pat. No. 10,221,687 B2, to cause spallation over an aerially larger spall area which may be useful when the sought-after mineral 12 is contained within an ore type stratum 11. The Mining Array 43 has a frame that is generally rectilinear having two horizontally spaced upper beams 57 and two horizontally spaced lower beams 58 the upper beams and the lower beams 58 each having opposing end portions. A horizontal transverse beam 59 extends between the spacedly adjacent end portions of the two upper beams 57, and also between the spacedly adjacent end portions of the two lower beams 58 to maintain the upper beams 57 and the lower beams 58 in horizontal parallel spaced adjacency. Vertical spacing beams structural interconnect the adjacent end portions of the upper beams 57 and the lower beams 58 to form the generally rectilinear frame 61. A cable mount arch extends parallel to the two spaced apart upper beams 57 and interconnects at its end portions with the upper horizontal transverse beams 59 at generally medial positions thereon. The cable mount arch supports a cable mount for releasable engagement with the Flexible Cable 20 carried by the Transport Vehicle 19 and its Crane 41 mechanism. A chip receiver 62 may be carried vertically below the two spaced apart lower beams 58 to receive sinned chips from the spall area. The chip receiver 62 may be configured with individual storage compartments 64 and also with trapdoors 65 (or similar structures) to allow spalled chips 63 to pass therethrough. The individual storage compartments 64 and the trapdoors 65 may be operable by an operator using the servo controller 23 and operator interface to ensure that sought-after minerals 12 are collected in the chip receiver 62 while mining waste is allowed to pass through the trapdoor 65 or allowed to drop to a lower drift 29.

Spacing apparatus on shock absorbing mounts 66 facilitate movement of the mining array 43 along the work surface and assist in maintaining the desirable predetermined distance between the rotating portion of the Scanhead 22 and the spall area to facilitate effective spalling which necessitates that the focal point of the EMR beams be upon the span area.

Nearly any number of Scanheads 22, ranging from one to a plurality, may be carried on the frame and the Scanheads 22 are positioned thereon so that the spall area formed by each Scanhead 22 is immediately adjacent to the spall area of an adjacent Scanhead 22 causing spalling across a larger area, such as when large volumes of ore are being removed.

An X-ray Fluorescence emitter/receiver 67 (hereafter XRF emitter/receiver 67), an illumination device 68 and a Video Camera 69 may be carried by the frame. The XRF emitter/receiver 67 emits predetermined wavelength of electromagnetic radiation upon the work surface causing reflectivity, illumination, and luminescence of various desirable sought-after minerals 12 that may be present within the stratum 11. The receiver portion/function of the XRF emitter/receiver 67 receives the reflected/emitted electromagnetic radiation from the sought-after mineral and registers the receipt of such reflected electromagnetic radiation which is indicative of the presence and concentration/density of the sought-after mineral 12. The presence of the sought-after mineral 12 is thereupon operatively communicated to the controller and user interface that may be being monitored by an operator or being automatically monitored such as with an Artificial Intelligence (AI system). The illumination device 68 provides light (electromagnetic radiation) that is projected upon the work surface which allows the Video Camera 69 to record and monitor operations of the spalling generated by the Scanhead(s) 22 or Drill Head 48. Video information recorded by the Video Camera 69 is communicated/transmitted to the operator and the user interface for monitoring at a remote location.

The physical configuration of the individual or plural Scanheads 22 when mounted on the Mining Array 43 may be somewhat different than the environmentally sealed Drill Head 48 configuration used for borehole drilling since it is not necessary that the Scanheads 22 mounted on the Mining Array 43 have motion control units because the position and/orientation of the Mining Array 43 may be controlled by the Servo-Controller 23, the Crane mechanism 41 and also by the spacing apparatus.

The pressurized air is emitted through the air curtain orifice and onto the work surface. The pressurized air impacting the work surface cools the spall area immediately before it is irradiated by the collimated EMR beam and instantaneously heated to extreme temperatures causing rapid expansion and thermal fracturing of the stratum 11. Immediate subsequent cooling of the stratum 11 by the pressurized air causes rapid contraction of the stratum 11 which leads to the spalling of the work surface and formation of spalled chips 63 which are removed therefrom. It is the rapid heating and rapid cooling that generates the spalling of the work surface.

The Mining Array 43 is configured for spallation mining in vertical stopes, and also in angulated drifts and in Winzes and Raises where the Mining Array 43 is movable by gravity, and also by the Crane 41 mechanism of the Transport Vehicle 19. The Mining Array 43 is therefore movable in at least two opposing directions, in a first direction by gravity, and in a second direction opposite gravity, as well as somewhat horizontally relative to the work surface by means of the spring mechanisms that maintain the predetermined desirable distance between the Scanhead 22 and the work surface as the Mining Array 43 is moved and spallation mining continues.

A proximity switch carried by the Mining Array 43 is used to monitor and maintain a predetermined desirable distance from the rotating portion of the Scanhead 11 to the work surface for optimum operation, so that the focal point of each laser beam irradiates the work surface. Movement of the spacing mechanism in response to operation of the Crane 41 mechanism is preferably computer controlled. Operator control of the Video Cameras 69, Illumination Device 68, XRF emitter/receiver 67, and the Crane mechanism 41 allow the operator to analyze the direction and width of narrow veins and selectively program the Scanhead 22 to extract only the desired mineral.

Subsequent passes of the mining array may be used to remove remaining stratum.

The Transport Vehicle 19 is contemplated to carry the necessary servo components to control the Scanhead 11 or Drill Head 48 for operation, the Optical Elements 50, Servo System 23, face mapping data generated by Video Cameras 69, the XRF emitter/receiver 67, as well as operational controls for the pressurized air, and the chip removal system, and Chip Receiver 62 of the Mining Array 43. The equipment Transport Vehicle 19 preferably carries and supports the necessary number sources of Electromagnetic Radiation 10 and other operating equipment, such as, but not limited to, Fiber Optic Cables 18, Electronic and Electrical Cables 20, Compressed Air Hose(s) 20 and associated Winches and other equipment.

The apparatus of our invention generally comprises a ytterbium doped, diode pumped, Fiber Laser (EMR) 10, a Flexible Cable 20 defining at least one Fiber Optic Cable 18 conduit capable of transmitting up to at least 4 kW of EMR photon power over a distance of up to approximately 300 feet as well as a gaseous supply conduit capable of flowing a minimum of approximately 100 CFM at 100 psi, and a shielded conduit capable of transmitting sufficient electrical power over the distance of approximately 300 feet to operate servo controlled Azimuth Drives 51 and positional location devices, Illumination Devices 68, Video Cameras 69, electronic controls and signal return cables for the Mining Array 43 components.

The collimated EMR beam is transmitted through the Fiber-Optic Cable 18 from a first end portion which communicates with the source of EMR 10 that is preferably mounted on the Transport Vehicle 19, to a second end portion which communicates, through the water-cooled Fiber Optic Coupler 39, with the water-cooled Optical Collimator 40 within the Scanhead 22 or Drill Head 48. The water-cooled Optical Collimator 40 encloses the beam expanding optical elements and beam collimating optical elements. Cooling orifices communicating with the source of ultra-filtered compressed air 16, or source of chilled liquid 17 operatively communicate with the water-cooled Fiber Optic Coupler, part of the Fiber Optic Cable 18, and water-cooled Optical Collimator 40 so that pressurized cooling water flows into the Fiber-Optic Coupler and Optical Collimator 40 housing to provide cooling and temperature control for the Fiber Optic Coupler and Optical Collimator 40 optical elements.

As the EMR photon beam exits the water-cooled Collimator 40, within the Scanhead 22 or Drill Head 48, the now collimated and focused to infinity EMR photon beam is directed to a first Folding Optical Element 54, which is coated with a proprietary and highly reflective coating in a wavelength of the collimated EMR photon beam.

The second Oscillating Optical Element 55 is mounted on a set of flexural pivots and a servo-controlled Azimuth Drive 51 to allow the position and angle of the second Oscillating Optical Element 55 to be adjusted as necessary to rapidly translate the collimated EMR photon beam one beam diameter. This second Oscillating Optical Element 55 is driven by the controller 23 such that its frequency of translation can be altered either by a predetermined controller control or based upon feedback from associated instrumentation.

The collimated EMR photon beam is then subsequently directed to the third Scanning Optical Element 56 which is also movably mounted on a servo-controlled Azimuth Drive 51, and which is also coated with a proprietary highly reflective coating in the wavelength of the EMR photon beam source. Control software provides fine control over the translation of the third Scanning Optical Element 56 to manage the total travel of the collimated EMR photon beam on the spall area.

The collimated EMR photon beam passes through the protective piano Refractive Window 53 which is protected by the air curtain of pressurized air to allow the collimated EMR photon beam to irradiate the spall area. The second 55 and third 56 Reflective Optical Elements 50 are separately mounted on servo-controlled Azimuth Drives 51 which communicate with the controller. The collimated EMR photon beam is thus able to be directed, based on the diameter of the collimated EMR photon beam upon the selected spall area. All three elements 54, 55, 56 receive a flow of cooling gas which is supplied by the cooling orifices within the Scanhead and directed upon the elements. The cooling gas is subsequently exhausted from the rotating portion of the Scanhead 22, through ports defined therein, to assist in forming the air curtain adjacent to the exterior of the protective piano Refractive Window 53. Additional high-pressure air nozzles within the Scanhead may be carried proximate to the air curtain orifice 71 to direct a stream of cooling gas upon the spall area to deflect chips and to dilute any excess vapors.

Having briefly described our method and apparatus, its operation may be understood.

In use, an appropriately sized Mining Array 43 will be lowered from an upper drift. The collimated EMR photon beams, directed by the rotating portions of the Scanhead 22 irradiate the work surface and begin cutting/spalling chips which are collected into a Chip Receiver 62 and subsequently may be dropped by means of gravity to a lower drift. Ore may be separated from waste in the Chip Receiver 62, by selective cutting.

A principle object of the present apparatus is for narrow vein mining using electromagnetic radiation which is comprised of a source of electromagnetic radiation 10 for generating a beam of electromagnetic radiation that is transmitted to a work surface of a strata 11; a source of liquid cooling media 17 for cooling the source of electromagnetic radiation 10 and for cooling the Fiber Optic Coupler and the Optical Collimator, 4; a source of cooling media 16 for cooling the work surface upon which the beam of electromagnetic radiation is transmitted; having means to filter the compressed air 37 (part of compressed air system); a source of electrical energy 38 operatively communicating with the source of electromagnetic radiation 10; a flexible cable 20 having opposing end portions, and defining plural internal conduits extending between the opposing end portions, one end portion of the flexible cable 20 operatively communicating with the source of electromagnetic radiation 10, the source of cooling media 17, the source of electrical energy 37, and the source of compressed air 37, and a second end portion of the flexible cable 20 operatively communicating with a Scanhead 22; the Scanhead 22 is operatively interconnected with the second end portion of the flexible cable 20 and the Scanhead 22 is configured for spalling, or configured for drilling, the Scanhead 22 having a body that has a first end portion, a second end portion, and a defines an internal cavity, and wherein an azimuth rotating dome 49 is carried at the first end portion of the body of the Scanhead 22, and the azimuth rotating dome 49 is controllably rotatably movable by means of a motor 47, and a protective piano refractive window 53 is carried by the rotating dome 49, and the protective piano refractive window 53 allows electromagnetic radiation generated by the source of electromagnetic 10 radiation to pass therethrough to the worksurface of the geological stratum 11 containing a desired material and/or gemstones, and plural optical elements 50 within the internal cavity of the body, are positioned in predetermined spaced relation relative to one another, and relative to the protective piano refractive window 53, and each of the plural optical elements 50 are individually controllably movable along predetermined courses of travel so as to transmit the beam of electromagnetic radiation through the protective piano refractive window 53, and drive means 51 operatively interconnected with each of the plural optical elements 50 to individually control movement of each of the plural optical elements 50, a cooling media vent is defined in the body of the Scanhead 22, and proximate the first end portion thereof, to eject and disperse cooling media upon the work surface, an air curtain orifice defined in the Scanhead body proximate the first end portion thereof, the air curtain orifice pneumatically communicating with the source of compressed air 16 so as to vent/direct compressed air over and about the protective piano refractive window 53 so as to prevent accumulation and deposits of dirt and debris thereon, and to remove spalled chips from the worksurface, plural cooling media vents spacedly arrayed within the internal cavity of the Scanhead body, the plural cooling media vents oriented and configured to provide cooling media to each of the plural optical elements 50, and a fiber-optic coupler 39 operatively interconnects a conduit of a flexible cable 20 transmitting the electromagnetic radiation from the source of electromagnetic radiation 10 through the fiber optic coupler to an optical collimator 40 within the internal cavity of the Scanhead 22; and a controller 23 operatively communicating with the source of electromagnetic radiation 10, the source of cooling media 17, the source of electrical energy 38, the source of compressed air 16, the Scanhead 22, the drive means 51, and the azimuth rotating dome motor 52 within the interior cavity defined by the Scanhead 22.

A further object of the present apparatus for narrow vein mining using electromagnetic radiation further comprises a manipulable robotic arm 21 having opposing end portions, and plural individually manipulable interconnected segments therebetween, and one end portion of the manipulable robotic arm 21 is interconnected with the second end portion of the Scanhead 22 so as to manipulate the position, angle, orientation and/or extension of the Scanhead 22 relative to the work surface; and the second end portion of the manipulable robotic arm 21 is interconnected to a supporting means.

A further object of the present apparatus for narrow vein mining using electromagnetic radiation further comprises a transport vehicle 19 for the source of electromagnetic radiation 10, the source of cooling media 17, the source of electrical energy 38, the source of compressed air 16, a hoist, and means for extending, or retracting and storing the flexible cable 20.

A further object of the present apparatus for narrow vein mining using electromagnetic radiation further comprises an x-ray fluorescence emitter/receiver 67 that emits and receives electromagnetic radiation, at a predetermined wavelength, to and from the work surface so as to generate reflectivity, illumination, and luminescence of sought-after minerals and/or gemstones, the x-ray fluorescence emitter operatively communicating with the source of electrical energy 38 and the controller 23.

A further object of the present apparatus for narrow vein mining using electromagnetic radiation further comprises a mining array 43 having plural spacedly arrayed and individually controllable Scan heads 22, the mining array 43 having a generally rectilinear frame having horizontally spaced upper and lower beams, a horizontal transverse beam that extends between spacedly adjacent end portions of the horizontally spaced upper and lower beams to maintain the upper and lower beams in a horizontal parallel spaced adjacency, and vertical spacing beams structurally interconnect adjacent end portions of the upper and lower beams to form the generally rectilinear frame; a cable mount carried by the generally rectilinear frame operatively communicates with a hoist/crane, and a chip receiver is carried vertically below the generally rectilinear framed to receive spalled chips from the work surface, and spacers mounted on shock absorbing mounts carried by the generally rectilinear frame, and operatively communicating with the controller, maintain a predetermined distance between the refractive windows of the plural Scanheads 22 and the work surface.

A further object of the present apparatus for narrow vein mining using electromagnetic radiation further comprises an optical monitor/video camera 69 carried by the generally rectilinear frame and operatively communicating with the controller 23.

A further object of the present apparatus for narrow vein mining using electromagnetic radiation further comprises a proximity sensor 70 carried by the generally rectilinear frame, and operatively communicating with the controller 23 so as to facilitate precise positioning of the generally rectilinear frame and plural Scanheads 22 carried thereon relative to the work surface.

A further object of the present apparatus for narrow vein mining using electromagnetic radiation further comprises a fiber-optic cable carried with in the flexible cable 20, the fiber-optic cable 18 having capabilities of transmitting at least approximately 4 kW of electromagnetic radiation over a distance of up to approximately 300 feet.

A further object of the present apparatus for narrow vein mining using electromagnetic radiation further comprises a water-cooled optical collimator 40 operatively interconnected between the source of electromagnetic radiation 10, and the flexible cable 20.

A further object of the present apparatus for narrow vein mining using electromagnetic radiation and wherein the plural optical elements 50 within the Scan head 22 include a folding optical element 54, an oscillating optical element 55 and a scanning optical element 56.

A further object of the present apparatus for narrow vein mining using electromagnetic radiation and wherein the drive means 51 within the Scanhead 22 are servo-controlled Azimuth drives.

A further object of the present apparatus for narrow vein mining using electromagnetic radiation and wherein the source of electromagnetic radiation 10 is an ytterbium doped, diode pumped, Fiber Laser.

A further object of the present apparatus for narrow vein mining using electromagnetic radiation and wherein the generated beam of electromagnetic radiation is moved on the work surface in a given pattern with a predetermined scan time and with a predetermined dwell time.

A further object of the present apparatus for narrow vein mining using electromagnetic radiation further comprises a chip removal system 62 for evacuating spalled chips from an area immediately adjacent the Scanhead 22 and for transporting the evacuated spalled chips to a remote location.

A further object of the present apparatus for narrow vein mining using electromagnetic radiation and wherein a predetermined desirable distance between the protective piano refractive window 53 and the work surface is approximately between 30 cm and 60 cm and even more preferably a distance of 7.5 cm and 25 cm.

A further object of the present apparatus for narrow vein mining using electromagnetic radiation and wherein the source of electromagnetic radiation generates a photon beam having a power range of approximately between 0.4 kW to approximately 4.0 kW.

A further object of the present apparatus for narrow vein mining using electromagnetic radiation and wherein the source of electromagnetic radiation 10 generates a laser photon beam having a power range of approximately between 0.4 kW and 4.0 kW.

A further object of the present apparatus for narrow vein mining using electromagnetic radiation and wherein the cooling media 17 is a liquid.

A still further object of the present invention is a method for narrow vein mining using electromagnetic radiation comprising the steps: identifying a strata 11 containing a desired material; providing a source of electromagnetic radiation 10 for generating a beam of electromagnetic radiation that is transmitted to a work surface of the strata 11; providing a source of cooling media 17 for cooling the source of electromagnetic radiation 10 and for cooling the work surface upon which the beam of electromagnetic radiation is transmitted; providing a source of compressed air 37 having means to filter the compressed air; providing a source of electrical energy 38 operatively communicating with the source of electromagnetic radiation 10, the source of cooling media 17 and the source of compressed air 38; providing a flexible cable 20 having opposing end portions, and defining plural internal conduits that extend between the opposing end portions, one end portion of the flexible cable 20 operatively communicating with the source of electromagnetic radiation 10, the source of cooling media 17, the source of electrical energy 38, and the source of compressed air 37, and a second end portion of the flexible cable 20 operatively communicating with a Scanhead 22; providing the Scanhead 22 that is configured for spalling, or configured for drilling, the Scanhead 22 having a body that has a first end portion, a second end portion, and defines an internal cavity, and wherein an azimuth rotating dome 49 is carried at the first end portion of the body of the Scanhead 22, and the azimuth rotating dome 49 is rotatably movable by means of a motor 52, and a protective piano refractive window 53 is carried by the rotating dome 49, and the protective piano refractive window 53 allows the beam of electromagnetic radiation to pass therethrough, and plural optical elements 50 are carried within the internal cavity of the body, and are positioned in predetermined space relation relative to one another, and relative to the protective and piano refractive window 53, and each of the plural optical elements 50 are individually controllably movable along predetermined courses of travel so as to transmit the beam of electromagnetic radiation through the protective piano refractive window 53 and onto the work surface, and drive means 51 operatively interconnected with each of the plural optical elements 50 to individually control movement of each of the plural optical elements 50; a cooling media vent defined in the body of the Scanhead 22, and proximate the first end portion thereof to eject and disperse cooling media upon the work surface to cool the worksurface prior to the work surface being irradiated by the beam of electromagnetic radiation, plural cooling media vents spacedly arrayed within the internal cavity of the Scanhead body, the plural cooling media vents oriented and configured to provide cooling media to each of the plural optical elements 50, and an air curtain orifice defined in the Scanhead 22 body proximate the first end portion thereof, the air curtain orifice pneumatically communicating with the source of compressed air 37 so as to vent/direct compressed air over and about the protective piano refractive window 53 so as to prevent accumulation and deposits of dirt and debris thereon, and to remove spalled chips from the worksurface, a fiber-optic coupler 39 operatively interconnects the conduit of the flexible cable 20 transmitting the electromagnetic radiation from the source of electromagnetic radiation 10 with an optical collimator 40 within the internal cavity of the Scanhead 22; and providing a controller 23 operatively communicating with the source of electromagnetic radiation 10, the source of cooling media 17, the source of electrical energy 38, the source of compressed air 37, the Scanhead 22, and the drive means 51 within the interior cavity defined by the Scanhead 22; and positioning the Scanhead 22 a predetermined desirable distance from the worksurface of the strata 11 containing the sought after material; energizing the source of electromagnetic radiation 10, the source of cooling media 17, the source of electrical energy 38 and the source of compressed air 37; and ejecting a quantity/volume of cooling media through cooling vents defined in the body of the Scanhead 22 onto a predetermined position on the worksurface to reduce the surface temperature of the predetermined position where the cooling media is ejected onto the work surface, and then moving the predetermined position to another predetermined position in a predetermined pattern of movement; energizing the source of electromagnetic radiation 10 and irradiating, with the electromagnetic radiation, the predetermined position on the worksurface that was previously cooled by the ejected cooling media, so as to cause spalling of the predetermined position on the worksurface, and then moving the position to be irradiated by the electromagnetic radiation to the next position on the worksurface cooled by the ejected cooling media so as to cause continuous spalling of chips from the worksurface; and collecting and removing the spalled chips, and refining and processing the collected and removed spalled chips to remove the sought after material from the collected and removed spalled chips.

An even still further object of the present inventive method for narrow vein mining using electromagnetic radiation further comprises the step providing a manipulable robotic arm 21 that carries the Scanhead 22 at one end portion of the manipulable robotic arm 21; the manipulable robotic arm 21 having opposing end portions, and plural individually manipulable interconnected segments therebetween; and manipulating the manipulable robotic arm 21 in a predetermined course of movements to irradiate the work surface to cause spalling of the worksurface.

Various portions and components of the instant invention, including for example, but not limited to, structural components, can be formed by one or more various manufacturing processes known to those in the art.

This disclosure and description have set out various features, functions, methods capabilities, uses and other aspects of our invention. This has been done with regard to the currently preferred embodiments thereof. Time and further development may change the manner in which the various aspects are implemented.

The scope of protection accorded the inventions as defined by the claims is not intended to be limited to the specific sizes, shapes, features, or other aspects of the currently preferred embodiments shown and described. The claimed inventions may be implemented or embodied in other forms while still being within the concepts shown, disclosed, described, and claimed herein. Also included are equivalents of the inventions which can be made without departing from the scope of concepts properly protected hereby.

Having thusly described and disclosed our Method and Apparatus for using Electro-Magnetic Radiation in Narrow Vein Mining, we file this Utility Patent Application we file this US Non-Provisional Patent Application and respectfully request issuance of Utility Letters Patent.

We claim:

1. An apparatus for using electromagnetic radiation in narrow vein mining, comprising:

a source of electromagnetic radiation for generating a beam of electromagnetic radiation that is transmitted to a work surface of a strata;

a source of cooling media for cooling the source of electromagnetic radiation and for cooling the strata work surface upon which the beam of electromagnetic radiation is transmitted;

a source of compressed air;

a source of electrical energy operatively communicating with the source of electromagnetic radiation, the source of cooling media and the source of compressed air;

a flexible cable having opposing end portions, and defining plural internal conduits extending between the opposing end portions, one end portion of the flexible cable operatively communicating with the source of electromagnetic radiation, the source of cooling media, the source of electrical energy, and the source of compressed air, and a second end portion of the flexible cable operatively communicating with a scan head;

a movement arm having a first end and a second end and defining an internal cavity, and wherein the movement arm has plural axially aligned and axially rotatable pivot points that provide horizontal and vertical movement to position/orient and to positionally maintain the scan head at a predetermined location and at a predetermined distance spaced apart from the work surface; and drive means within the movement arm operatively connect to each of the plural axially aligned and axially rotatable pivot points to individually control each of the plural pivot points; and the scan head has a first end portion and a second end portion and is operatively interconnected with the second end portion of the movement arm and the scan head is configured for spalling, or configured for drilling, the scan head having, an azimuth rotating dome is carried at the first end portion of the scan head, and the azimuth rotating dome is controllably rotatably movable by means of a motor, and a protective plano refractive window is carried by the rotating dome, and the protective plano refractive window allows electromagnetic radiation generated by the source of electromagnetic radiation to pass therethrough to the worksurface strata containing a desired material and/or gemstones, and plural optical elements within the scan head, are positioned in predetermined spaced relation relative to one another, and relative to the protective plano refractive window, and each of the plural optical elements are individually controllably movable along predetermined courses of travel so as to transmit the beam of electromagnetic radiation through the protective plano refractive window, and drive means operatively interconnected with each of the plural optical elements to individually control movement of each of the plural optical elements, a cooling media vent is defined in the scan head, to eject and disperse cooling media upon the work surface, an air curtain orifice defined in the scan head proximate the first end portion thereof, the air curtain orifice pneumatically communicating with the source of compressed air to vent/direct compressed air over and about the protective plano refractive window to prevent accumulation and deposits of dirt and debris thereon, and to remove spalled chips from the worksurface, plural cooling media vents spacedly arrayed within the scan head, the plural cooling media vents oriented and configured to provide cooling media to each of the plural optical elements, and a fiber-optic coupler operatively interconnects a conduit of a flexible cable transmitting the electromagnetic radiation from the source of electromagnetic radiation with an optical collimator operatively communicating with the scan head; and a controller operatively communicating with the source of electromagnetic radiation, the source of cooling media, the source of electrical energy, the source of compressed air, the scan head, the drive means for the plural pivot points, and the azimuth rotating dome motor of the scan head.

2. The apparatus for using electromagnetic radiation in narrow vein mining, as claimed in claim 1 and wherein the movement arm has a first pivot point that provides limited horizontal movement, which is driven through a predetermined angle by a servo-controlled motor/gearhead; and a second pivot point, at a predetermined distance from the first pivot point, that provides limited vertical movement, which is driven through a predetermined angle by a servo-controlled motor/gearhead; and a third pivot point. at a predetermined distance from the second pivot point, that provides limited horizontal movement which is driven through a predetermined angle by a servo-controlled motor/gearhead to counteract the movement of the first pivot point; and a fourth pivot point at a predetermined distance from the third pivot point, that provides limited vertical movement which is driven through a predetermined angle by a servo-controlled motor/gearhead to counteracts the movement of the second pivot point.

3. The apparatus for using electromagnetic radiation in narrow vein mining, as claimed in claim 1 and further comprising:

an x-ray fluorescence emitter/receiver that emits and receives electromagnetic radiation, at a predetermined wavelength, to and from the work surface so as to generate reflectivity, illumination, and luminescence of sought-after minerals and/or gemstones, the x-ray fluorescence emitter operatively communicating with the source of electrical energy and the controller.

4. The apparatus for using electromagnetic radiation in narrow vein mining, as claimed in claim 1 and further comprising:

a mining array having plural spacedly arrayed and individually controllable scan heads, the mining array having a generally rectilinear frame having horizontally spaced upper and lower beams, a horizontal transverse beam that extends between spacedly adjacent end portions of the horizontally spaced upper and lower beams to maintain the upper and lower beams in a horizontal parallel spaced adjacency, and vertical spacing beams structurally interconnect adjacent end portions of the upper and lower beams to form the generally rectilinear frame;

a cable mount carried by the generally rectilinear frame operatively communicates with a hoist/crane, and a chip receiver is carried vertically below the generally rectilinear framework to receive spalled chips from the work surface, and spacers mounted on shock absorbing mounts carried by the generally rectilinear frame, and operatively communicating with the controller, maintain a predetermined distance between the refractive windows of the plural scan heads and the work surface.

5. The apparatus for using electromagnetic radiation in narrow vein mining, as claimed in claim 4 and further comprising:

an optical monitor/video camera carried by the generally rectilinear frame and operatively communicating with the controller.

6. The apparatus for using electromagnetic radiation in narrow vein mining, as claimed in claim 4 and further comprising:

a proximity sensor operatively communicating with the controller so as to facilitate and maintain precise positioning of the generally rectilinear frame and plural scan heads carried thereon relative to the work surface.

7. The apparatus for using electromagnetic radiation in narrow vein mining, as claimed in claim 1 and further comprising:

a fiber-optic cable carried with in the flexible cable, the fiber-optic cable having capabilities of transmitting at least approximately 4 KW of electromagnetic radiation over a distance of up to approximately 300 feet.

8. The apparatus for using electromagnetic radiation in narrow vein mining, as claimed in claim 1 and wherein the source of electromagnetic radiation is a ytterbium doped, diode pumped, Fiber Laser.

9. The apparatus for using electromagnetic radiation in narrow vein mining, as claimed in claim 1 and wherein the generated beam of electromagnetic radiation is moved on the work surface in a given pattern with a predetermined scan time and with a predetermined dwell time.

10. The apparatus for using electromagnetic radiation in narrow vein mining, as claimed in claim 1 and wherein a predetermined desirable distance between the protective plano refractive window and the work surface is between 30 cm and 60 cm.

11. The apparatus for using electromagnetic radiation in narrow vein mining, as claimed in claim 1 and wherein the source of electromagnetic radiation generates a laser beam having a power range of between 0.4 kW to approximately 4.0 kW.

12. A method for using electromagnetic radiation in narrow vein mining, comprising the steps:

identifying a strata containing a desired material;

providing a source of electromagnetic radiation for generating a beam of electromagnetic radiation that is transmitted to a work surface of the strata;

providing a source of cooling media for cooling the source of electromagnetic radiation and for cooling the work surface upon which the beam of electromagnetic radiation is transmitted;

providing a source of compressed air having means to filter the compressed air;

providing a source of electrical energy operatively communicating with the source of electromagnetic radiation, the source of cooling media and the source of compressed air;

providing a flexible cable having opposing end portions, and defining plural internal conduits that extend between the opposing end portions, one end portion of the flexible cable operatively communicating with the source of electromagnetic radiation, the source of cooling media, the source of electrical energy, and the source of compressed air, and a second end portion of the flexible cable operatively communicating with a scan head;

providing a movement arm having a first end and a second end and defining an internal cavity, and wherein the movement arm has plural axially aligned and axially rotatable pivot points that provide horizontal and vertical movement to position/orient and to positionally maintain the scan head at a predetermined location and at a predetermined distance spaced apart from the work surface, and wherein drive means within the movement arm operatively connect to each of the plural axially aligned and axially rotatable pivot points to individually control each of the plural pivot points; and providing the scan head that has a first end portion and a second end portion and that is configured for spalling, or configured for drilling, and wherein an azimuth rotating dome is carried at the first end portion of the scan head, and the azimuth rotating dome is rotatably movable by means of a motor, and a protective plano refractive window is carried by the rotating dome, and the protective plano refractive window allows the beam of electromagnetic radiation to pass therethrough, and plural optical elements are carried within the scan head, and are positioned in predetermined space relation relative to one. another, and relative to the protective and plano refractive window, and each of the plural optical elements are individually controllably movable along predetermined courses of travel so as to transmit the beam of electromagnetic radiation through the protective plano refractive window and onto the work surface, and drive means operatively interconnected with each of the plural optical elements to individually control movement of each of the plural optical elements;

a cooling media vent defined in the scan head, and proximate the first end portion thereof to eject and disperse cooling media upon the work surface to cool the worksurface prior to the work surface being irradiated by the beam of electromagnetic radiation, plural cooling media vents spacedly arrayed within the scan head body, the plural cooling media vents oriented and configured to provide cooling media to each of the plural optical elements, and an air curtain orifice defined in the scan head proximate the first end portion thereof, the air curtain orifice pneumatically communicating with the source of compressed air so as to vent/direct compressed air over and about the protective plano refractive window to prevent accumulation and deposits of dirt and debris thereon, and to remove spalled chips from the worksurface, a fiber-optic coupler operatively interconnects the conduit of the flexible cable transmitting the electromagnetic radiation from the source of electromagnetic radiation with an optical collimator; and providing a controller operatively communicating with the source of electromagnetic radiation, the source of cooling media, the source of electrical energy, the source of compressed air, the scan head, and the drive means for the plural pivot pointes of the movement arm, and the rotating dome motor of the scan head; and positioning the scan head a predetermined desirable distance from the worksurface containing the sought-after material, and the predetermined desirable distance from the worksurface is between 30 cm and 60 cm;

energizing the source of electromagnetic radiation, the source of cooling media, the source of electrical energy and the source of compressed air; and ejecting a quantity/volume of cooling media through cooling vents defined in the scan head onto a predetermined position on the worksurface to reduce the surface temperature of the predetermined position where the cooling media is ejected onto the work surface, and then moving the predetermined position to another predetermined position in a predetermined pattern of movement;

energizing the source of electromagnetic radiation and irradiating, with the electromagnetic radiation, the predetermined position on the worksurface that was previously cooled by the ejected cooling media, so as to cause spalling of the predetermined position on the worksurface, and then moving the position to be irradiated by the electromagnetic radiation to the next position on the worksurface cooled by the ejected cooling media so as to cause continuous spalling of chips from the worksurface; and collecting and removing the spalled chips, refining, and processing the collected and removed spalled chips to remove the sought-after material from the collected and removed spalled chips.

13. The method for using electromagnetic radiation in narrow vein mining, as claimed in claim 12, and further comprising the step:

providing a control signal from the controller that is communicated, via the flexible cable, to at least one servo-controlled motor/gearhead that operatively communicates with at least one axially aligned and axially rotatable pivot point of the movement arm to horizontally or vertically move the scan head to a position relative to the work surface that is a predetermined distance from the work surface.

14. A method of mining comprising:

providing a stratum having a sought after mineral;

providing a working surface of the stratum and upon which the method of mining may be operated;

providing sources of compressed air, electrical energy and electromagnetic radiation;

generating a laser beam with the sources of electricity and electromagnetic radiation, and which has a power sufficient to cause a spalling of the stratum and sought after mineral forming the work surface;

providing a flexible cable having a first end portion, and a second end portion and defining plural conduits extending therealong between the first end portion and the second end portion, and wherein the first end portion operatively communicates with the source of electromagnetic radiation, the source of compressed air, and the source of electrical energy;

delivering a predetermined amount of electromagnetic radiation to the first end portion of the flexible cable for transmission of the electromagnetic radiation therealong;

providing a scan head having a first end portion and a second end portion. and wherein the second end portion of the scan head operatively communicates with the second end of the flexible cable and further receives the electromagnetic radiation from the source of electromagnetic radiation, the flexible cable receives, and passes therealong, the compressed air from the source of compressed air, and the electrical energy from the source of electrical energy;

providing a rotating dome at the first end portion of the scan head and which operatively communicates with the source of electromagnetic radiation and wherein the rotating dome has a protective and transparent window, and plural, internal, reflective optical elements which are located in predetermined spaced relation relative to the protective transparent window and which are further contained within a body of the scan head, and wherein the reflective optical elements are individually controllably movable to transmit a laser beam through the protective transparent window, and onto a spall area of the work surface, and which is proximate to the rotating dome, and wherein the laser beam is moved in a given pattern having a predetermined scanning time, and a predetermined dwell time, so as to cause spalling of the stratum and which generates a multiplicity of spalled chips, and a removal of the sought after mineral from the spall area;

delivering the compressed air to the rotating dome so as to both cool the internal, reflective optical elements, and the spall area that has been previously irradiated by the laser beam so as to thermally control the stratum and sought after mineral, and which further promotes the cooling of the spall area while inhibiting the melting and vaporization of the stratum and the sought after mineral;

removing the spalled chips away from the spall area by the use of the source of compressed air;

providing a chip removal system having an evacuation port which is proximate to the rotating dome for evacuating the spalled chips from the spall area, and for propelling the spalled chips toward the second end of the scan head, and to a remote location for collection and processing;

providing a drive unit to move the scan head along a predetermined path of travel relative to the work surface, and to further maintain a distance between the rotating dome and the working surface which is between 30 cm and 60 cm to facilitate effective spalling and the generation of the spalled chips; and providing a controller operatively communicating with, and controllably coupled to the scan head, the drive unit, the source of electromagnetic radiation, the source of compressed air, the source of electrical energy, and the removal system, and wherein the controller is located remotely relative to the scan head. and further controls the operation of the scan head, the delivery of the compressed air, and the removal of the spalled chips by way of the removal system.

15. The method for using electromagnetic radiation in narrow vein mining, as claimed in claim 1 and further comprising:

a proximity sensor within the scan head; and the proximity sensor within the scan head operatively communicates with the controller to provide information to the controller relative to a determined distance between the scan head and the work surface so that the controller may provide control signals to the drive means of the movement arm to maintain the scan head at the predetermined desirable distance from the work surface for effective spalling.

* * * * *